US010922911B2

(12) United States Patent
Cameron et al.

(10) Patent No.: US 10,922,911 B2
(45) **Date of Patent: *Feb. 16, 2021**

(54) COLLAPSIBLE AND DEPLOYABLE INTERACTIVE STRUCTURE AND SYSTEM OF USE

(71) Applicant: BANK OF AMERICA CORPORATION, Charlotte, NC (US)

(72) Inventors: Jennifer A. Cameron, Cramerton, NC (US); Maria Cannizzo, San Jose, CA (US); Colin Christopherson, Somerville, MA (US); Kevin Albert Cooper, Monroe, NC (US); Rosemary Hill, Jacksonville, FL (US); Holly Trucco Hillary, Maitland, FL (US); Brian Joseph Smith, Saint Augustine, FL (US)

(73) Assignee: BANK OF AMERICA CORPORATION, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/730,461

(22) Filed: Dec. 30, 2019

(65) Prior Publication Data

US 2020/0134951 A1 Apr. 30, 2020

Related U.S. Application Data

(63) Continuation of application No. 16/110,836, filed on Aug. 23, 2018, now Pat. No. 10,521,991.

(51) Int. Cl.

| | |
|---|---|
| ***G07C 9/00*** | (2020.01) |
| ***G07C 9/32*** | (2020.01) |
| ***E04B 1/343*** | (2006.01) |

(52) U.S. Cl.
CPC ..... *G07C 9/00563* (2013.01); *G07C 9/00174* (2013.01); *G07C 9/00896* (2013.01);
(Continued)

(58) Field of Classification Search
None
See application file for complete search history.

(56) References Cited

U.S. PATENT DOCUMENTS

| | | | |
|---|---|---|---|
| 5,832,676 | A | 11/1998 | Gillmore et al. |
| 5,999,208 | A | 12/1999 | McNerney et al. |

(Continued)

FOREIGN PATENT DOCUMENTS

| | | | |
|---|---|---|---|
| EP | 1693801 | A2 | 8/2006 |
| WO | 9908215 | A1 | 2/1999 |
| WO | 2010040541 | A1 | 4/2010 |

*Primary Examiner* — Daniell L Negron
(74) *Attorney, Agent, or Firm* — Michael A. Springs; Moore & Van Allen PLLC; Nicholas C. Russell

(57) ABSTRACT

Embodiments of the present invention provide a system for the use of a collapsible and deployable interactive structure. An interactive structure that is collapsible and deployable is provided in an outdoor or interior location. The interactive structure includes at least a door with a locking mechanism, an interior display, and a physical presence sensor, and may include ceiling tiles made of melt-away material, external displays, and an external bench that houses electrical components. Communication with a user is initiated, and information about the user is obtained for authentication and identification purposes. The user is authenticated, thereby unlocking the door to allow the user to enter the interactive structure. Once the user is inside, the interior display is activated to allow an underlying system to communicate with the user to determine a desired action for with the user. The interior display and underlying system facilitate the performance of the desired action.

20 Claims, 11 Drawing Sheets

(52) U.S. Cl.
CPC ..... *G07C 9/32* (2020.01); *E04B 1/34315* (2013.01); *G07C 2209/64* (2013.01)

(56) References Cited

U.S. PATENT DOCUMENTS

| | | | | |
|---|---|---|---|---|
| 6,219,439 | B1 | 4/2001 | Burger | |
| 7,814,016 | B2 | 10/2010 | Pranger | |
| 7,967,192 | B1 | 6/2011 | Meek | |
| 8,489,887 | B1 | 7/2013 | Newman et al. | |
| 8,510,222 | B2 | 8/2013 | Bachrany et al. | |
| 8,725,641 | B2 | 5/2014 | Bachrany et al. | |
| 8,931,071 | B2 | 1/2015 | Newman et al. | |
| 9,344,279 | B2 | 5/2016 | Pieczul et al. | |
| 9,904,915 | B2 | 2/2018 | McCracken et al. | |
| 10,106,998 | B2 | 10/2018 | Lyons, Jr. | |
| 10,521,991 | B1 * | 12/2019 | Cameron | G07C 9/00563 |
| 2004/0107651 | A1 | 6/2004 | Johnson | |
| 2005/0171907 | A1 | 8/2005 | Lewis | |
| 2008/0031600 | A1 | 2/2008 | Robey | |
| 2015/0317639 | A1 | 11/2015 | Ward et al. | |
| 2015/0326934 | A1 | 11/2015 | Gravino et al. | |
| 2018/0204407 | A1 * | 7/2018 | Salemon | G07C 9/00904 |
| 2018/0274256 | A1 * | 9/2018 | El-Wakeel | B62B 3/005 |

* cited by examiner

COLLAPSIBLE AND DEPLOYABLE INTERACTIVE STRUCTURE AND SYSTEM OF USE

CROSS-REFERENCE TO RELATED APPLICATION

This application is a continuation of and claims priority from allowed, co-pending U.S. patent application Ser. No. 16/110,836, filed on Aug. 23, 2018, and entitled "COLLAPSIBLE AND DEPLOYABLE INTERACTIVE STRUCTURE AND SYSTEM OF USE," the entire disclosure of which is hereby incorporated by reference.

BACKGROUND

Interacting with users to perform actions that involve sensitive information poses significant information and data security concerns. While these concerns can be mitigated or alleviated though permanent brick and mortar structures, the concerns are still prevalent at locations where permanent structures are not yet available or feasible, or when a need for facilitating these actions is only temporary. Therefore, the combination of strict security and data privacy procedures with a collapsible, transportable, and deployable physical interactive structure that performs most or all of the functions of a permanent structure, are desirable to facilitate these actions in temporary or non-traditional environments.

BRIEF SUMMARY

The following presents a summary of certain embodiments of the invention. This summary is not intended to identify key or critical elements of all embodiments nor delineate the scope of any or all embodiments. Its sole purpose is to present certain concepts and elements of one or more embodiments in a summary form as a prelude to the more detailed description that follows.

Embodiments of the present invention address the above needs and/or achieve other advantages by providing apparatuses (e.g., a system, computer program product and/or other devices) and methods for the use of a collapsible and deployable interactive structure and system. The system embodiments may comprise one or more memory devices having computer readable program code stored thereon, a communication device, and one or more processing devices operatively coupled to the one or more memory devices, wherein the one or more processing devices are configured to execute the computer readable program code to carry out the invention. In computer program product embodiments of the invention, the computer program product comprises at least one non-transitory computer readable medium comprising computer readable instructions for carrying out the invention. Computer implemented method embodiments of the invention may comprise providing a computing system comprising a computer processing device and a non-transitory computer readable medium, where the computer readable medium comprises configured computer program instruction code, such that when said instruction code is operated by said computer processing device, said computer processing device performs certain operations to carry out the invention.

For sample, illustrative purposes, system environments will be summarized. The system may include an interactive structure that is collapsible and deployable, wherein the interactive structure comprises at least a door with a locking mechanism, an interior display, and a physical presence sensor. The system may be configured to initiate communication with a user and authenticate the user based on the communication with the user. In some embodiments, the system may unlock the locking mechanism of the door in response to authenticating the user. The system may then receive an indication from the physical presence sensor that the user is inside the interactive structure. The system can then cause the interior display to communicate with the user to determine a desired action associated with the user, and ultimately perform the desired action associated with the user.

In some embodiments of the system, the interactive structure further comprises at least one of the following components: side panels, window panels, screen obfuscation film attached to at least a portion of the window panels, support struts, an external bench housing electronic components associated with one or more devices of the interactive structure, ceiling baffling, ceiling tiles comprising material configured to melt away in response to being exposed to water, a local cellular network hot-spot configured to connect one or more devices associated with the interactive structure, a customer camera, a security camera, a door access device, and one or more external displays.

In some embodiments of the system, initiating the communication with the user comprises receiving a user input, via a touch screen of an external display of the interactive structure, of a request to enter the interactive structure, and prompting, via the external display of the interactive structure, the user to provide authentication credentials of the user. The system may then receive the authentication credentials of the user and, in response to receiving the authentication credentials of the user, unlock the locking mechanism of the door.

Additionally or alternatively, initiating the communication with the user may comprise receiving user information, including authentication credentials of the user, from a mobile computing device of a specialist that has communicated with the user.

In some embodiments of the system, initiating communication with the user comprises receiving authentication credentials of the user via an access device associated with the door of the interactive structure. In such embodiments, the system may additionally authenticate the user based on the communication with the user comprises confirming that the received authentication credentials of the user matches information associated with the user stored in an authentication database.

The system may, in some embodiments, determine an identity of the user based on identification information provided by the user.

In embodiments of the system, the determined action performed by the internal display comprises a predicted desired action. In such embodiments, the system may be configured to determine a purpose of the user for engaging with the interactive structure and predict a desired action for the user based on the purpose of the user for engaging with the interactive structure. The system can then collect available user information and user account information necessary to perform the predicted desired action and request, via the interior display, confirmation from the user to perform the predicted desired action. The system can further request, via the interior display, additional information necessary to perform the predicted desired action from the user. The system can then receive user input, via the interior display or a mobile computing device of the user, comprising the additional information necessary to perform the predicted desired action from the user. Finally, in response to receiving the user input comprising the additional information necessary to perform the predicted desired action, the system may perform the predicted desired action and display information associated with the action to the user.

The features, functions, and advantages that have been discussed may be achieved independently in various embodiments of the present invention or may be combined with yet other embodiments, further details of which can be seen with reference to the following description and drawings.

Having thus described embodiments of the invention in general terms, reference will now be made the accompanying drawings, wherein:

BRIEF DESCRIPTION OF THE DRAWINGS

Figure 1:
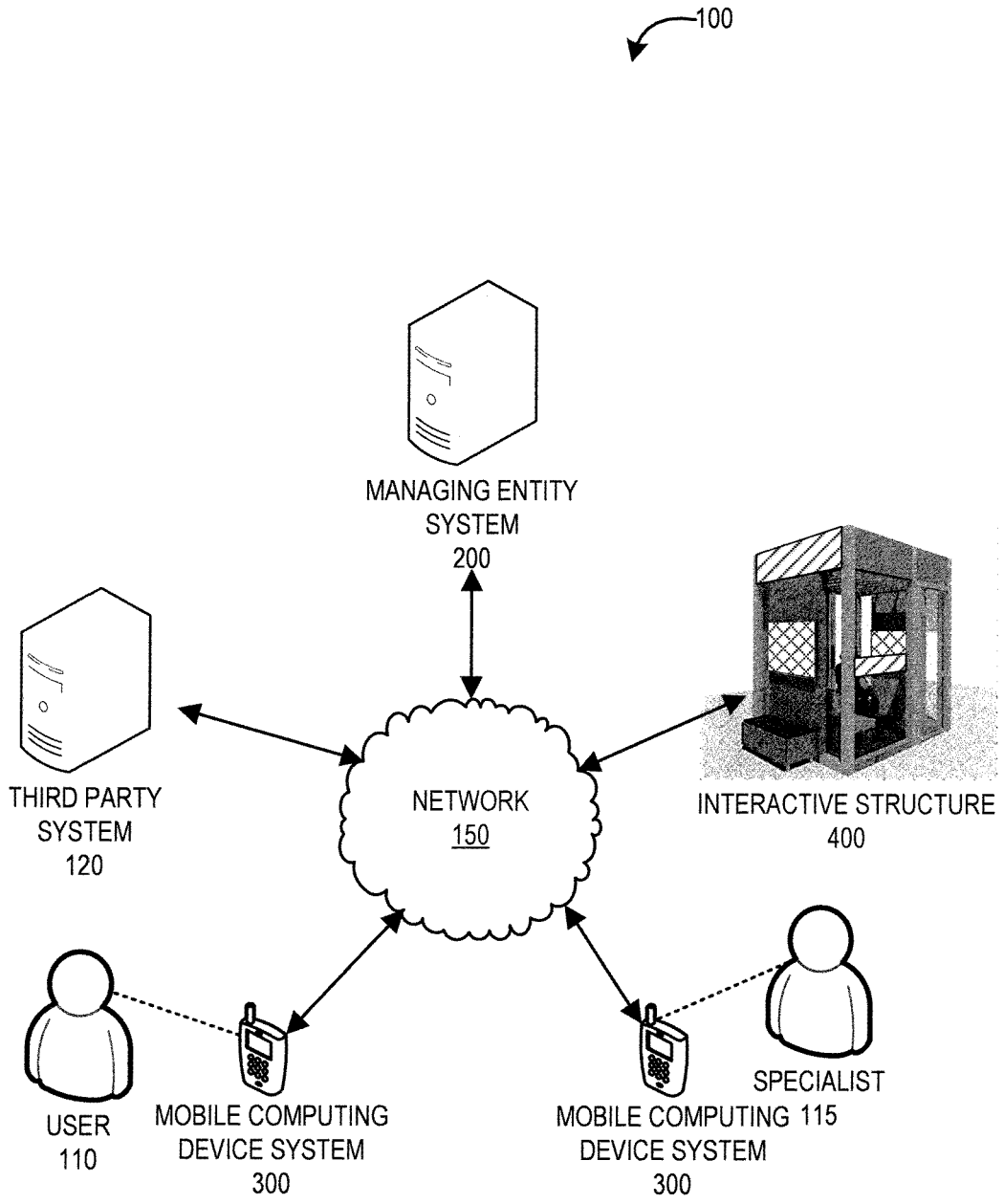
Figure 2:
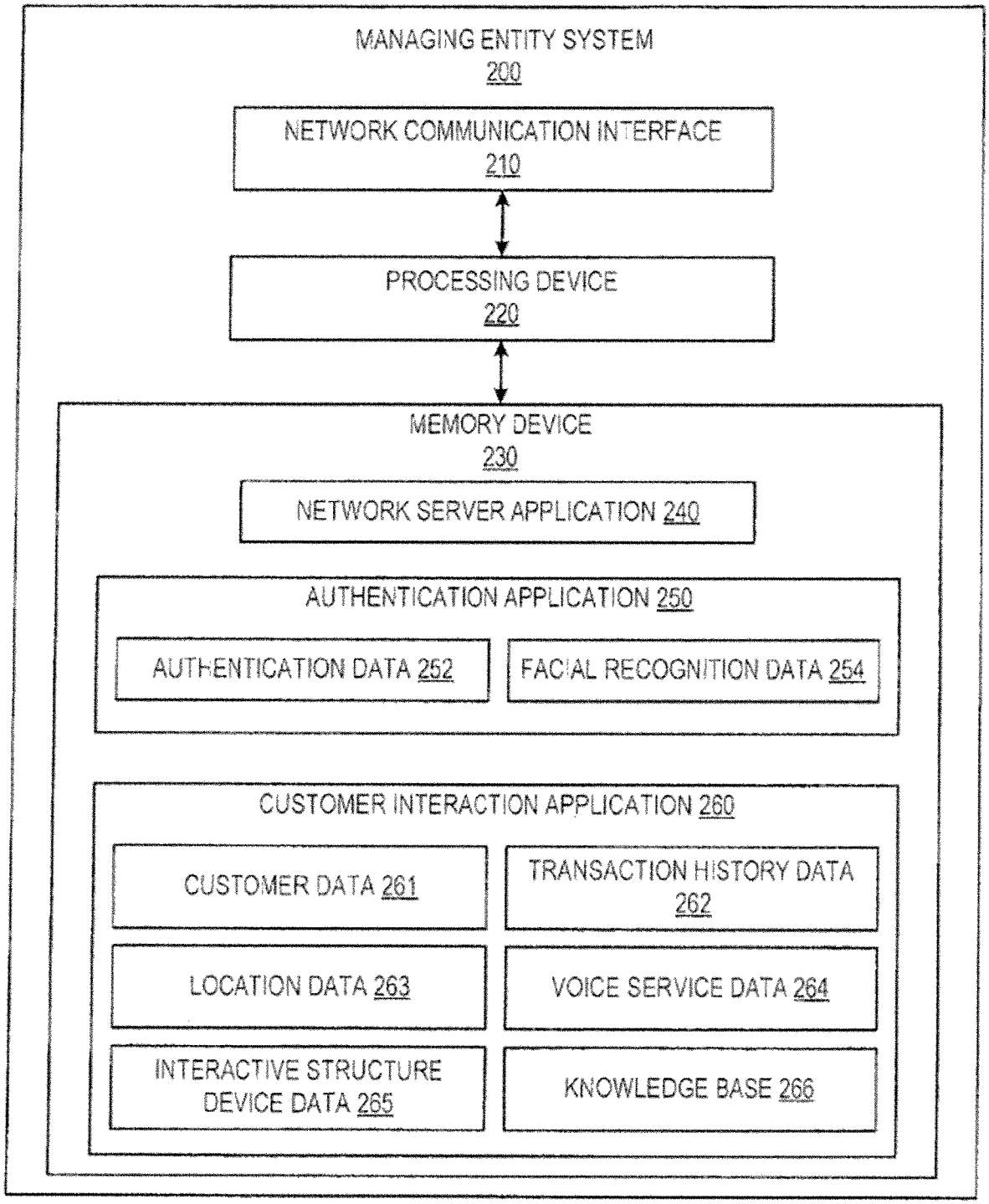
Figure 3:
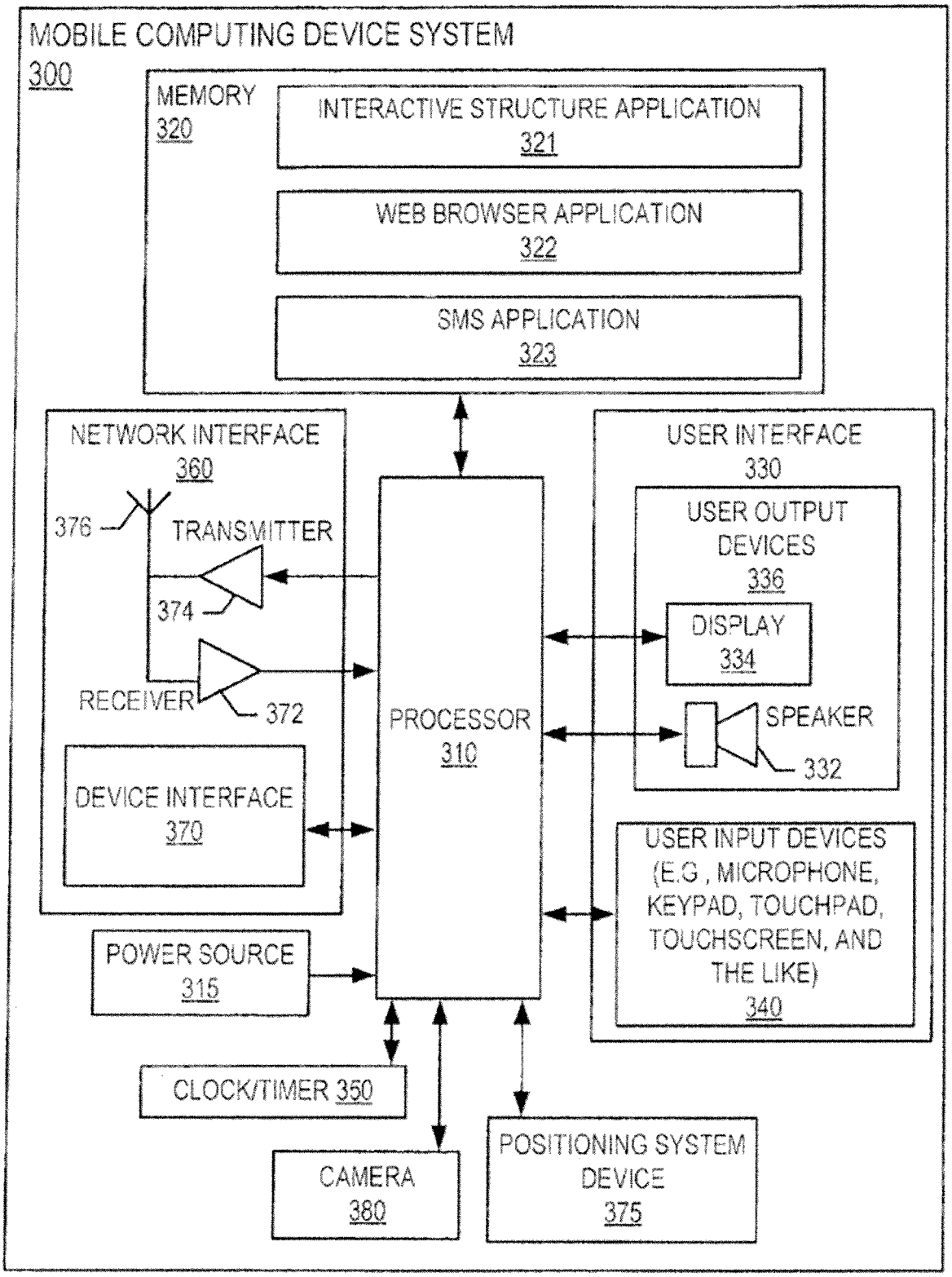
Figure 4A:
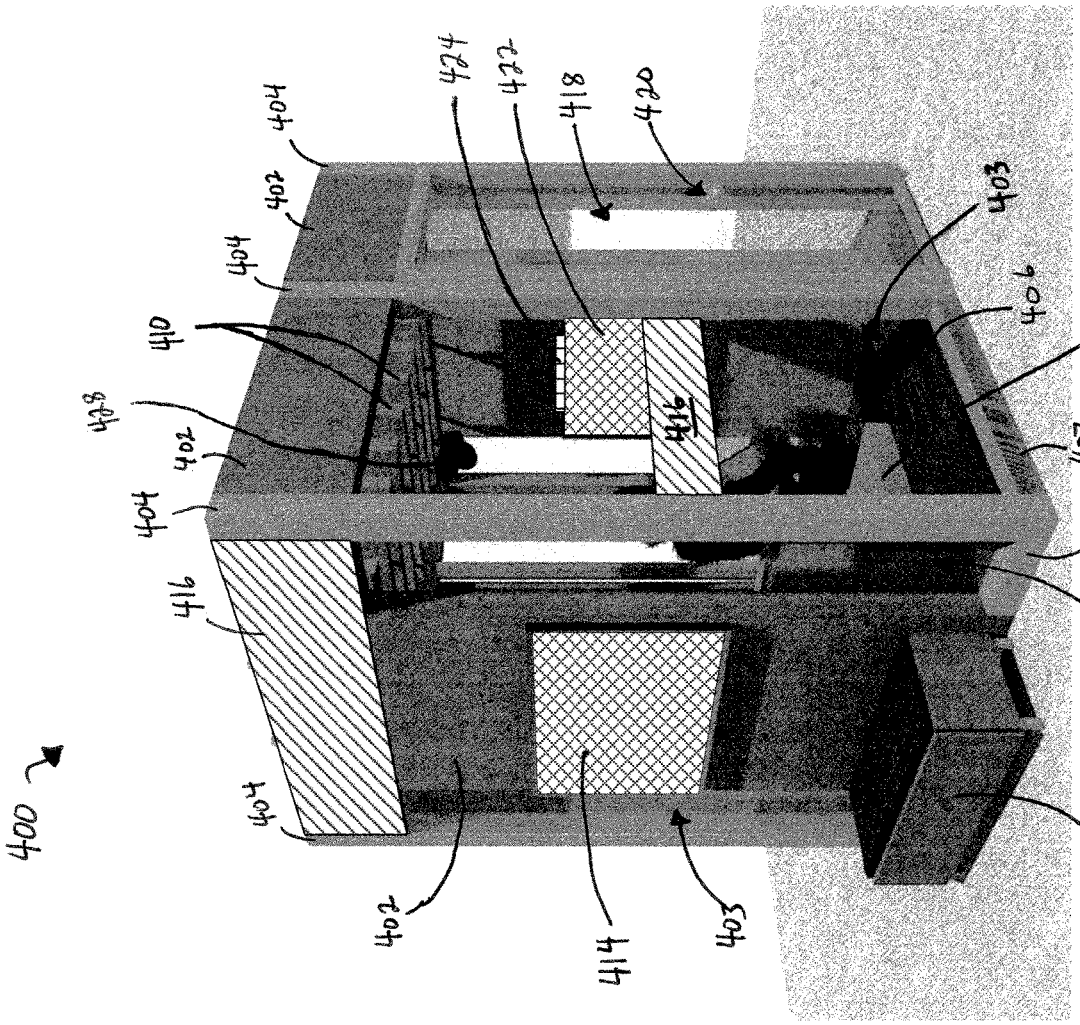
Figure 4B:
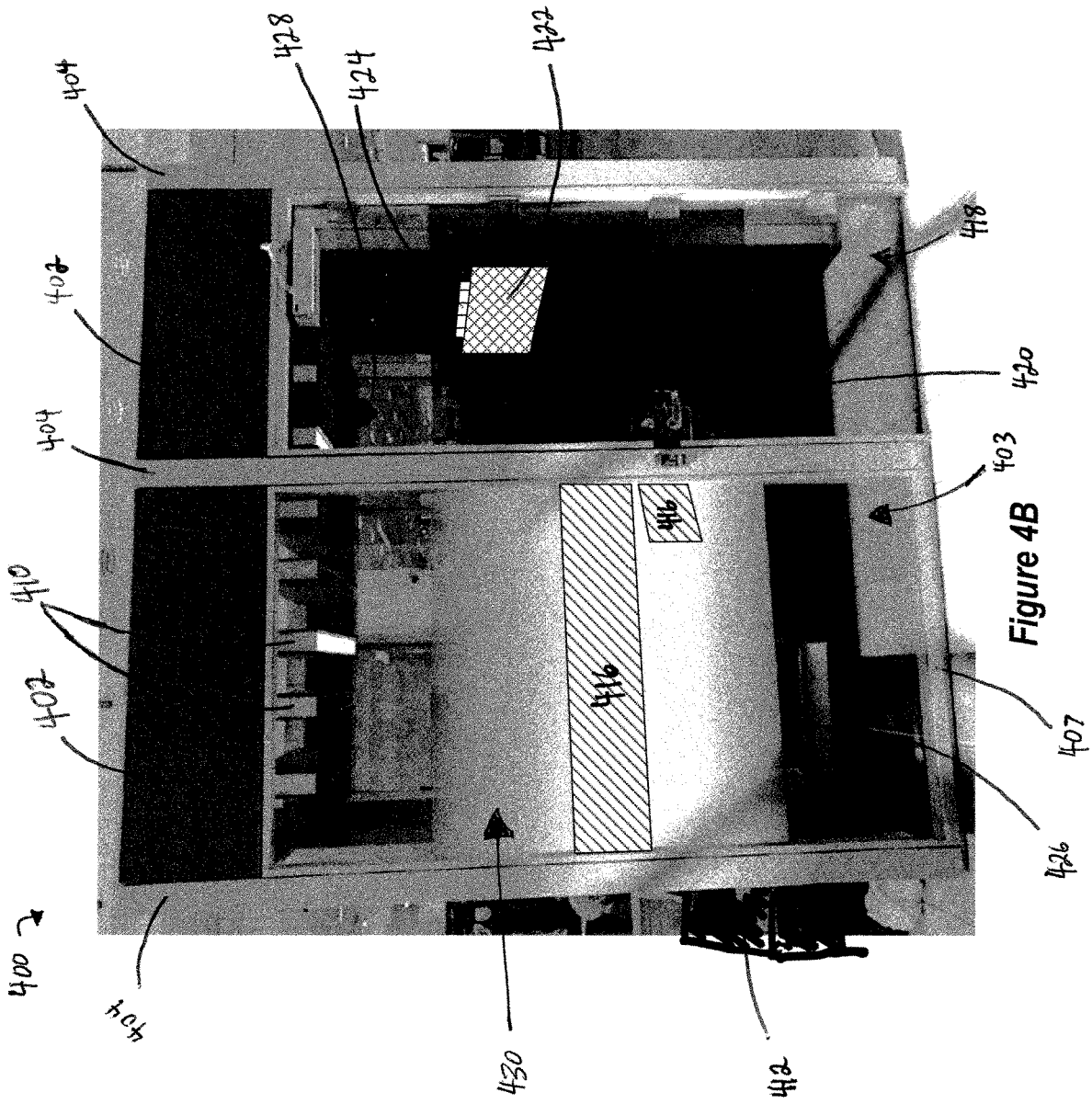
Figure 4C:
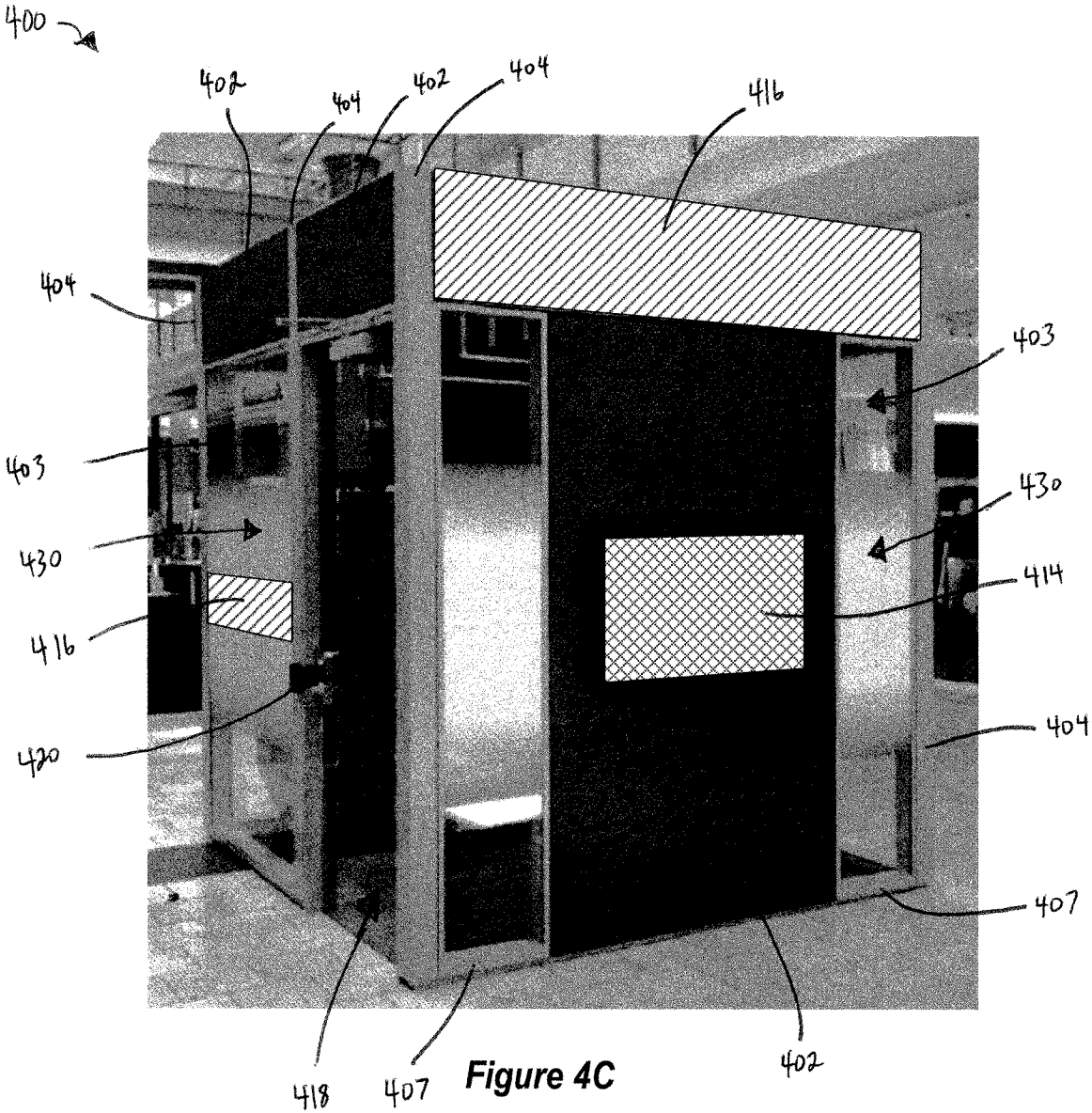
Figure 4D:
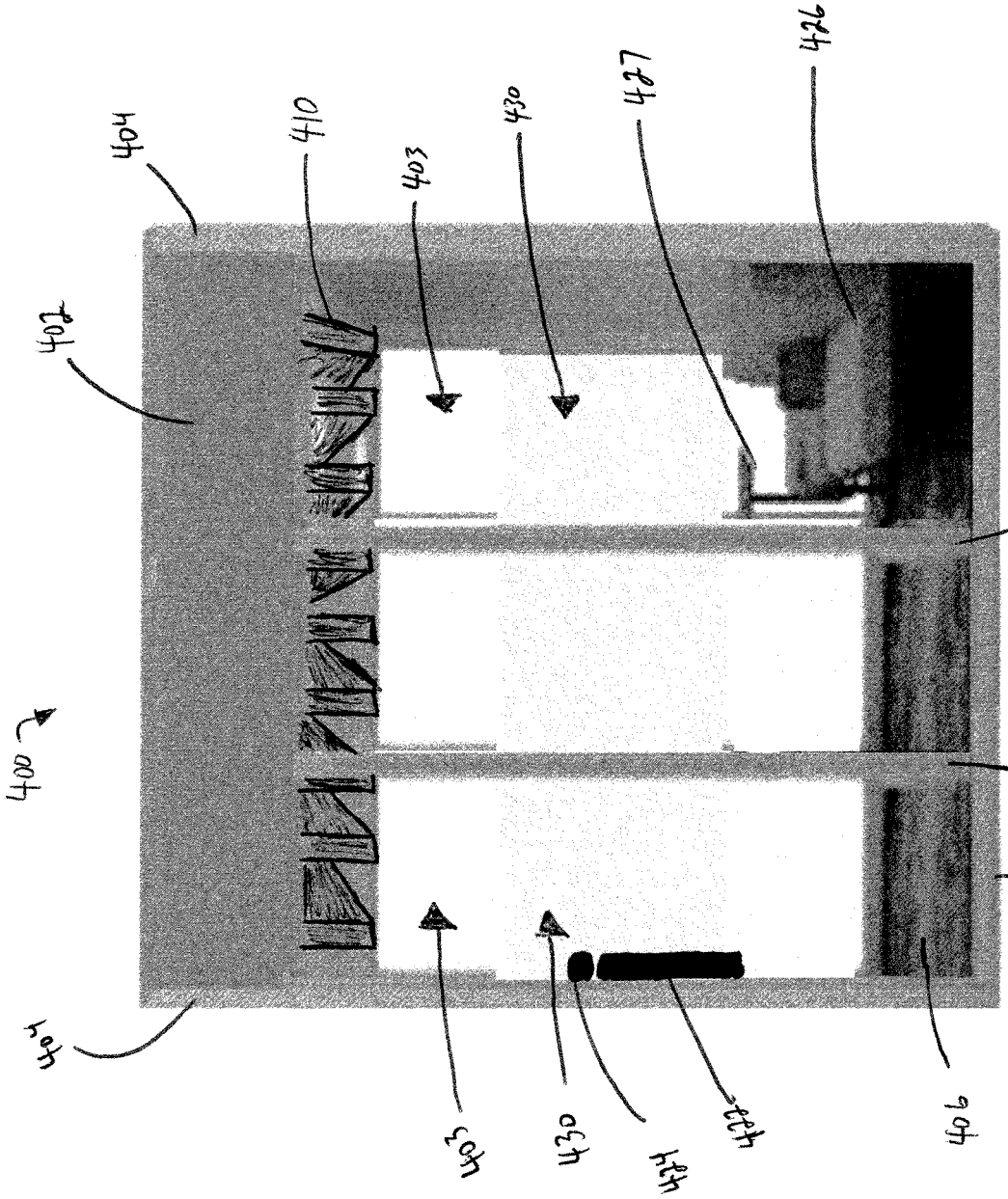
Figure 4E:
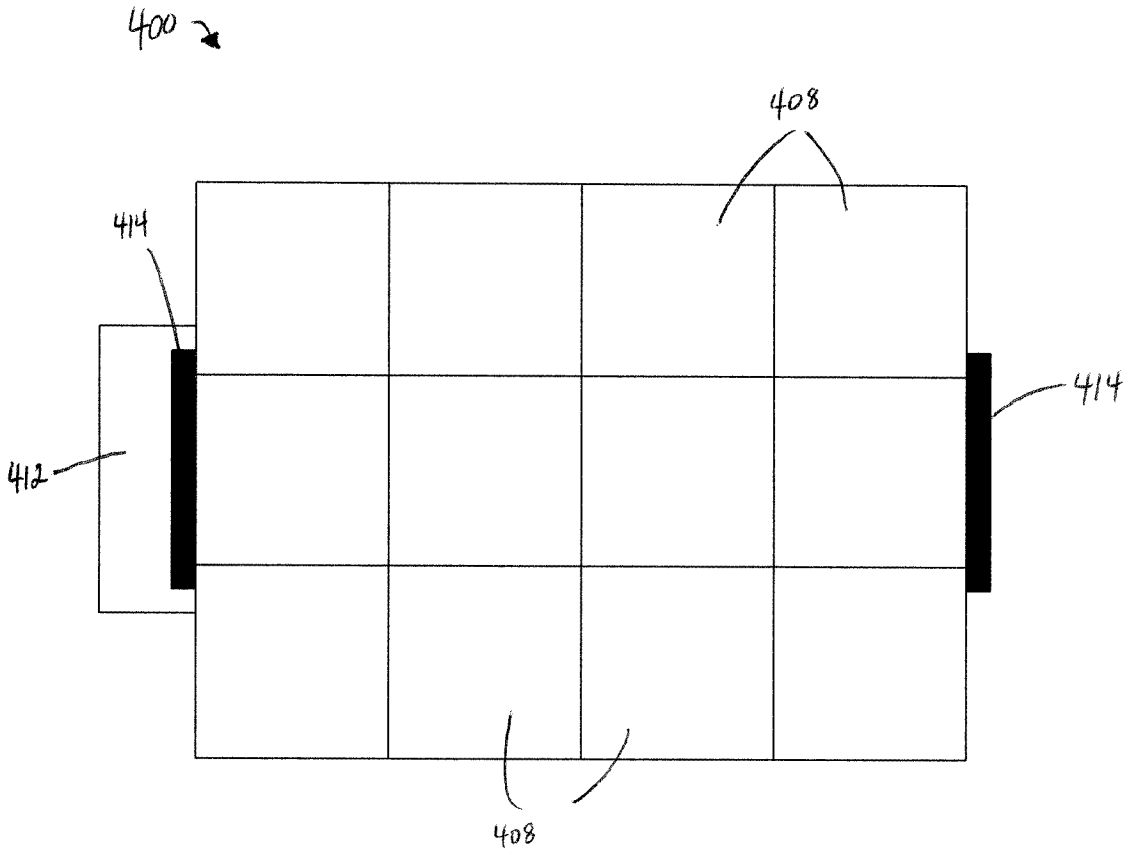
Figure 4F:
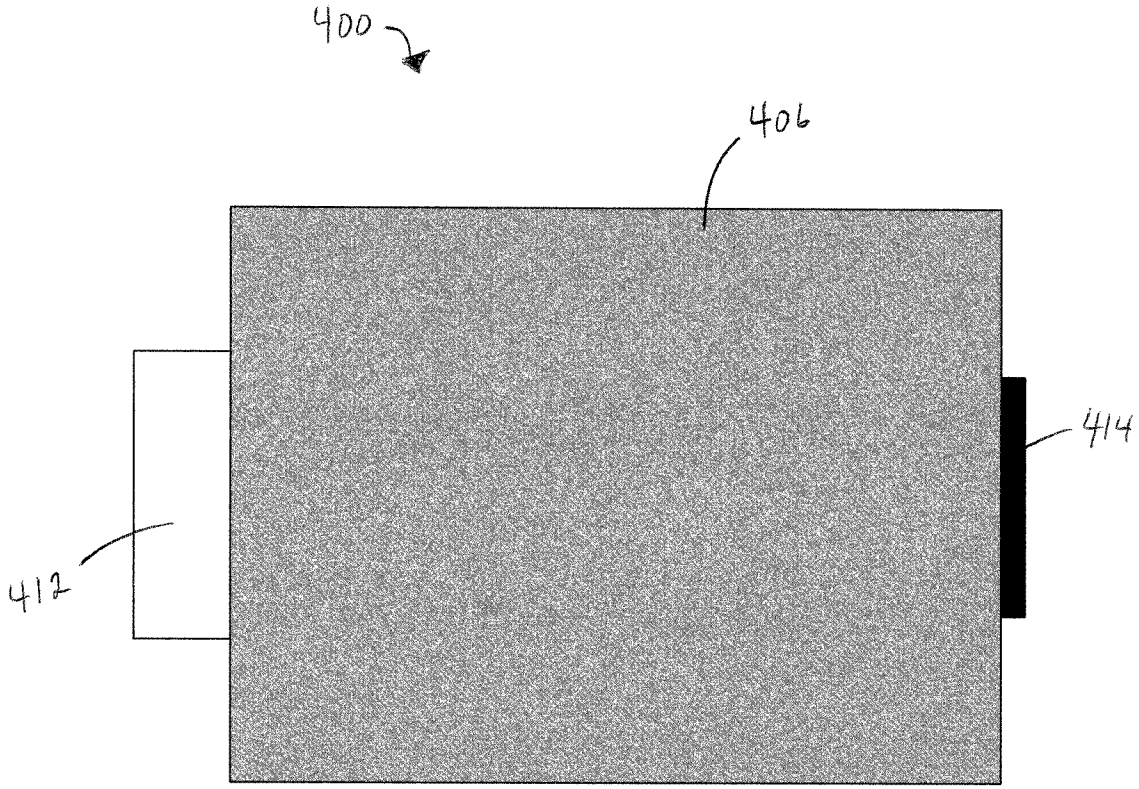
Figure 4G:
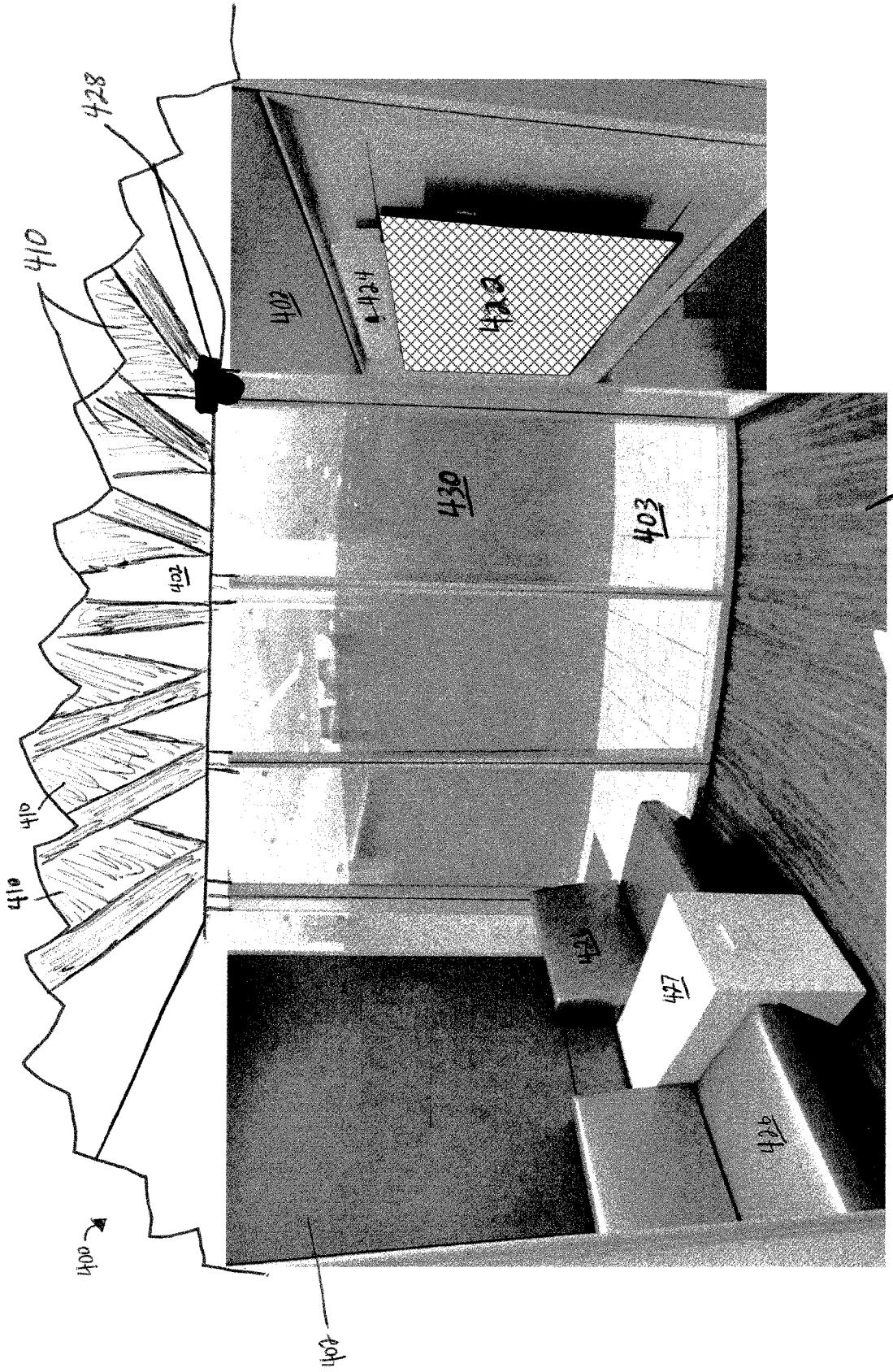
Figure 5:
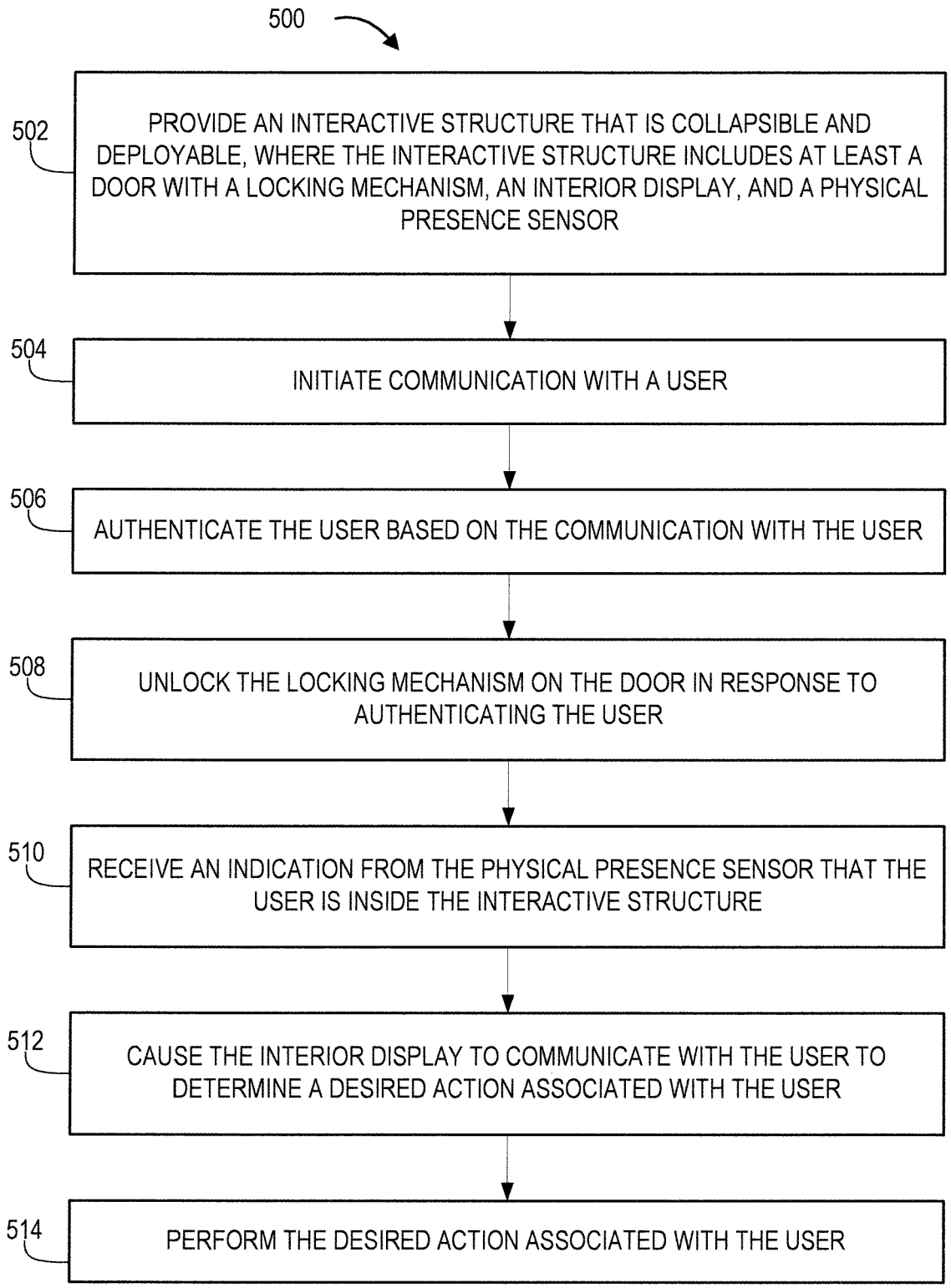

Having thus described embodiments of the invention in general terms, reference will now be made the accompanying drawings, wherein:

FIG. 1 provides a block diagram illustrating a system environment for the use of a collapsible and deployable interactive structure, in accordance with an embodiment of the invention;

FIG. 2 provides a block diagram illustrating the managing entity system of FIG. 1, in accordance with an embodiment of the invention;

FIG. 3 provides a block diagram illustrating the mobile computing device system of FIG. 1, in accordance with an embodiment of the invention;

FIG. 4A provides an illustrated perspective view of the interactive structure, including a frontal portion of the interactive structure, from FIG. 1, in accordance with an embodiment of the invention;

FIG. 4B provides an illustrated frontal view of the interactive structure from FIG. 1, in accordance with an embodiment of the invention;

FIG. 4C provides an illustrated perspective view of the interactive structure, including a rear portion of the interactive structure, from FIG. 1, in accordance with an embodiment of the invention;

FIG. 4D provides an illustrated rear view of the interactive structure from FIG. 1, in accordance with an embodiment of the invention;

FIG. 4E provides a top view of the interactive structure from FIG. 1, in accordance with an embodiment of the invention;

FIG. 4F provides a bottom view of the interactive structure from FIG. 1, in accordance with an embodiment of the invention;

FIG. 4G provides a perspective view of the interior of the interactive structure from FIG. 1, in accordance with an embodiment of the invention; and FIG. 5 provides a flowchart illustrating a process for the use of a collapsible and deployable interactive structure, in accordance with embodiments of the invention.

DETAILED DESCRIPTION OF EMBODIMENTS OF THE INVENTION

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein. Furthermore, when it is said herein that something is "based on" something else, it may be based on one or more other things as well. In other words, unless expressly indicated otherwise, as used herein "based on" means "based at least in part on" or "based at least partially on." Like numbers refer to like elements throughout.

FIG. 1 provides a block diagram illustrating a system environment 100 for use of a collapsible and deployable interactive structure, in accordance with an embodiment of the invention. As illustrated in FIG. 1, the environment 100 includes a managing entity system 200, one or more mobile computing device systems 300, an interactive structure 400 that includes a plurality of electronic and computing devices and systems, and one or more third party systems 120. One or more users 110 may be included in the system environment 100. In some embodiments, the user(s) 110 of the system environment 100 may be customers of, clients of, potential customers of, or any other individual that has a relationship with a managing entity that provides the interactive structure 400 and/or controls the managing entity system 200. For example, the managing entity 200 may comprise a financial institution and the user 110 may be a customer or potential customer of the financial institution. Additionally, one or more specialists 115 may be included in the system environment 100. A specialist 115 may be an employee of the managing entity, and may be stationed alongside the interactive structure 400 to assist users 110 in engaging with the interactive structure 400.

The user 110 and/or the specialist 115 may be able to interact with the managing entity system 200, the interactive structure 400 and/or the third party system 120 via their respective mobile computing device systems 300. Additionally or alternatively, the user 110 and/or the specialist 115 may be able to interact directly with one or more computing devices of the interactive structure (e.g., an interior display, a customer camera, an access device, an external display, and the like).

The managing entity system 200, the mobile computing device systems 300, the interactive structure 400, and/or the third party system 120 may be in network communication across the system environment 100 through the network 150. The network 150 may include a local area network (LAN), a wide area network (WAN), and/or a global area network (GAN). The network 150 may provide for wireline, wireless, or a combination of wireline and wireless communication between devices in the network. In one embodiment, the network 150 includes the Internet. In some embodiments, a dedicated and secure wireless network (e.g., a cellular network hot-spot) may be provided as a component of the interactive structure 400. This dedicated and secure wireless network may be considered part of the network 150. The dedicated and secure wireless network of the interactive structure 400 may comprise a The managing entity system 200 may be a system owned or otherwise controlled by a managing entity to perform one or more process steps described herein. In some embodiments, the managing entity is a financial institution. In general, the managing entity system 200 is configured to communicate information or instructions with the computing devices of the interactive structure 400, the mobile computing device systems 300, and/or the third party system 120 across the network 150. For example, the managing entity system 200 may receive a request from a computing device of the interactive structure to generate a document in preparation for performing an action for the user 110. The managing entity system 200 may then access a database to identify the appropriate form and the data fields that need to be entered, and then access a customer database and/or an account database to identify known information that can be used to populate the data fields before transmitting the at least partially-populated document back to the interactive structure 400. Of course, the managing entity system 200 may be configured to perform (or instruct other systems to perform) one or more other process steps described herein, especially with respect to the process 500 described in FIG. 5. The managing entity system 200 is described in more detail with respect to FIG. 2.

The mobile computing device systems 300 may be a system owned or controlled by the managing entity, the user 110, the specialist 115, and/or a third party that specializes in providing mobile devices to individuals. In general, each mobile computing device system 300 is configured to communicate information or instructions with the managing entity system 200, other mobile computing device systems 300, the computing devices of the interactive structure 400, and/or the third party system 120 across the network 150. For example, the mobile computing device system 300 of the user 110 may transmit, to a computing device (e.g., and exterior display or an access device) a request to access and engage with the interactive structure 400. The mobile computing device system 300 of the user 110 may further provide user input functions for the user 110 when the user 110 is interacting with the interior display of the interactive structure. As another example, the mobile computing device system 300 of the specialist 115 may be configured to transmit instructions to an exterior display of the interactive structure 400 to cause the exterior display to present a demonstration of an action that can be performed with the interactive structure 400 (e.g., via screen mirroring, via an online application, via an application stored on the exterior display, or the like). Of course, each mobile computing device system 300 may be configured to perform (or instruct other systems to perform) one or more other process steps described herein. An example mobile computing device system 300 is described in more detail with respect to FIG. 3.

The interactive structure 400 is described in detail with respect to FIG. 4, but generally comprises a physical structure that is configured to be easily broken apart, transported, and deployed in a new location. The interactive structure 400 includes multiple computer and electronic components and devices that interact with each other over a local wireless network and/or with the managing entity system 200, a mobile computing device system 300, and/or a third party system 120 via the network 150 (which may include the local wireless network).

The third party system 120 may be any system that provides support, information, databases, or the like to supplement or replace one or more of the devices or systems described herein. For example, the third party system 120 may comprise an automobile dealer system, where the interactive structure 400 is positioned within the automobile dealer system to facilitate automobile financing application processes for a user 110. In this way, the automobile dealer system (i.e., the third party system 120) provides a database of information about the automobile dealer, information about an automobile that is being purchased, approved forms or documents associated with a sale of an automobile, and the like.

FIG. 2 provides a block diagram illustrating the managing entity system 200, in greater detail, in accordance with embodiments of the invention. As illustrated in FIG. 2, in one embodiment of the invention, the managing entity system 200 includes one or more processing devices 220 operatively coupled to a network communication interface 210 and a memory device 230. In certain embodiments, the managing entity system 200 is operated by a first entity, such as a financial institution, while in other embodiments, the managing entity system 200 is operated by an entity other than a financial institution.

It should be understood that the memory device 230 may include one or more databases or other data structures/repositories. The memory device 230 also includes computer-executable program code that instructs the processing device 220 to operate the network communication interface 210 to perform certain communication functions of the managing entity system 200 described herein. For example, in one embodiment of the managing entity system 200, the memory device 230 includes, but is not limited to, a network server application 240, an authentication application 250 which includes authentication data 252 and facial recognition data 254. The memory device 230 may further include a customer interaction application 260 that includes or comprises customer data 261, transaction history data 262, location data 263, voice service data 264, interactive structure device data 265, and/or a knowledge base 266.

The computer-executable program code of the network server application 240, the authentication application 250, and/or the customer interaction application 260 may instruct the processing device 220 to perform certain logic, data-processing, and data-storing functions of the managing entity system 200 described herein, as well as communication functions of the managing entity system 200.

In one embodiment, the authentication application 250 includes authentication data 252 and facial recognition data 254. The authentication data 252 may comprise known and/or approved passcodes, passwords, security questions and answers to the security questions, biometric information, and other information about customers that can be compared to provided authentication information to determine whether a customer is authorized to access an interactive structure 400 (e.g., by matching the known authentication data 252). The facial recognition data 254 may comprise information, templates, known facial structures, and the like for one or more customers of the managing entity such that the managing entity system can identify, verify, and/or authenticate a user (e.g., the user 110) in response to receiving an image of the user from a camera of the interactive structure 400.

The customer interaction application 260 is configured to actively communicate with, and perform actions for, a customer (e.g., the user 110) engaging with the interactive structure 400. As such, the customer interaction application 260 may comprise customer data 261 that includes information known about the customer (e.g., account information, preferences, and the like), or information about the customer that is provided by the customer during an interactive session with one or more of the devices that are components of the interactive structure 400. Similarly, the transaction history data 262 includes a history of transactions, previous actions taken by the customer (e.g., at brick and mortar establishments, at the interactive structure 400 previously, at other interactive structures 400, and the like.) Furthermore, the customer interaction application 260 may include location data 263 for the customer and/or the interactive structure 400 to direct the customer to the interactive structure 400 (e.g., via directions that are transmitted to the mobile computing device system 300 of the customer). The location data 263 can also provide information that is aides the managing entity system 200 in predicting a desired action of the customer (e.g., the user 110), because the location of the interactive structure 400, may be indicative of the type(s) of action(s) that the customer will want to perform.

The voice service data 264 may be information, logic rules, and other data that enables or enhances the ability of the managing entity system 200 to receive verbal instructions, questions, answers, or other input from the customer within the interactive structure 400 (e.g., audio received from a microphone associated with the interior display of the interactive structure 400). The voice service data 264 may enable machine learning and/or artificial intelligence systems within the managing entity system 200 to determine context, goals, requests, instructions, and other user input, which enables the managing entity system 200 to determine a best manner in which to respond to the customer, including which products or services should be offered and/or explained to the customer.

The customer interaction application 260 may further include interactive structure device data 265 that may include or comprise physical presence sensors that may trigger the managing entity system 200 to cause one or more other devices or systems of the interactive structure 400 to activate, communicate, and/or perform actions for the customer. The interactive structure device data 265 may further include information and/or data provided by each computing and/or electronic device of the interactive structure 400 such that the managing entity system 200 is able to maintain and track information about a customer and the customer's interaction(s) with the devices of the interactive structure 400 over time to better understand how to assist the customer.

In some embodiments, the customer interaction application 260 includes a knowledge base 266 that includes a large amount of information that can be accessed and processed by machine learning and artificial intelligence systems of the managing entity system 200 to make any of the determinations, predictions, communication messages, and the like that are described herein.

The network server application 240, the authentication application 250, and/or the customer interaction application 260 are configured to invoke or use the authentication data 252, the facial recognition data 254, the customer data 261, the transaction history data 262, the location data 263, the voice service data 264, the interactive structure data 265, the knowledge base 266, and/or the like when communicating through the network communication interface 210 with the mobile computing device systems 300, the computing devices of the interactive structure 400, and/or the third party system 120.

As used herein, the network communication interface 210 is a communication interface having one or more communication devices configured to communicate with one or more other devices on the network 150, such as the computing device systems 300, the computing devices of the interactive structure 400, and/or the third party system 120. The processing device 220 is configured to use the network communication interface 310 to transmit and/or receive data and/or commands to and/or from the other devices connected to the network 150.

FIG. 3 provides a block diagram illustrating a mobile computing device system 300 of FIG. 1 in more detail, in accordance with embodiments of the invention. In one embodiment of the invention, the mobile computing device system 300 is a mobile telephone. However, it should be understood that a mobile telephone is merely illustrative of one type of mobile computing device system 300 that may benefit from, employ, or otherwise be involved with embodiments of the present invention and, therefore, should not be taken to limit the scope of embodiments of the present invention. Other types of computing devices may include portable digital assistants (PDAs), pagers, mobile televisions, gaming devices, desktop computers, workstations, laptop computers, cameras, video recorders, audio/video player, radio, GPS devices, wearable devices, Internet-of-things devices, augmented reality devices, virtual reality devices, automated teller machine devices, electronic kiosk devices, or any combination of the aforementioned.

Some embodiments of the mobile computing device system 300 include a processor 310 communicably coupled to such devices as a memory 320, user output devices 336, user input devices 340, a network interface 360, a power source 315, a clock or other timer 350, a camera 380, and a positioning system device 375. The processor 310, and other processors described herein, generally include circuitry for implementing communication and/or logic functions of the mobile computing device system 300. For example, the processor 310 may include a digital signal processor device, a microprocessor device, and various analog to digital converters, digital to analog converters, and/or other support circuits. Control and signal processing functions of the mobile computing device system 300 are allocated between these devices according to their respective capabilities. The processor 310 thus may also include the functionality to encode and interleave messages and data prior to modulation and transmission. The processor 310 can additionally include an internal data modem. Further, the processor 310 may include functionality to operate one or more software programs, which may be stored in the memory 320. For example, the processor 310 may be capable of operating a connectivity program, such as a web browser application 322. The web browser application 322 may then allow the mobile computing device system 300 to transmit and receive web content, such as, for example, location-based content and/or other web page content, according to a Wireless Application Protocol (WAP), Hypertext Transfer Protocol (HTTP), and/or the like.

The processor 310 is configured to use the network interface 360 to communicate with one or more other devices on the network 150. In this regard, the network interface 360 includes an antenna 376 operatively coupled to a transmitter 374 and a receiver 372 (together a "transceiver"). The processor 310 is configured to provide signals to and receive signals from the transmitter 374 and receiver 372, respectively. The signals may include signaling information in accordance with the air interface standard of the applicable cellular system of the wireless network 152. In this regard, the mobile computing device system 300 may be configured to operate with one or more air interface standards, communication protocols, modulation types, and access types. By way of illustration, the mobile computing device system 300 may be configured to operate in accordance with any of a number of first, second, third, and/or fourth-generation communication protocols and/or the like. For example, the mobile computing device system 300 may be configured to operate in accordance with second-generation (2G) wireless communication protocols IS-136 (time division multiple access (TDMA)), GSM (global system for mobile communication), and/or IS-95 (code division multiple access (CDMA)), or with third-generation (3G) wireless communication protocols, such as Universal Mobile Telecommunications System (UMTS), CDMA2000, wide-band CDMA (WCDMA) and/or time division-synchronous CDMA (TD-SCDMA), with fourth-generation (4G) wireless communication protocols, with LTE protocols, with 3GPP protocols and/or the like. The mobile computing device system 300 may also be configured to operate in accordance with non-cellular communication mechanisms, such as via a wireless local area network (WLAN) or other communication/data networks.

As described above, the mobile computing device system 300 has a user interface that is, like other user interfaces described herein, made up of user output devices 336 and/or user input devices 340. The user output devices 336 include a display 330 (e.g., a liquid crystal display or the like) and a speaker 332 or other audio device, which are operatively coupled to the processor 310.

The user input devices 340, which allow the mobile computing device system 300 to receive data from a user such as the user 110, may include any of a number of devices allowing the mobile computing device system 300 to receive data from the user 110, such as a keypad, keyboard, touch-screen, touchpad, microphone, mouse, joystick, other pointer device, button, soft key, and/or other input device(s). The user interface may also include a camera 380, such as a digital camera.

The mobile computing device system 300 may also include a positioning system device 375 that is configured to be used by a positioning system to determine a location of the mobile computing device system 300. For example, the positioning system device 375 may include a GPS transceiver. In some embodiments, the positioning system device 375 is at least partially made up of the antenna 376, transmitter 374, and receiver 372 described above. For example, in one embodiment, triangulation of cellular signals may be used to identify the approximate or exact geographical location of the mobile computing device system 300. In other embodiments, the positioning system device 375 includes a proximity sensor or transmitter, such as an RFID tag, that can sense or be sensed by devices known to be located proximate an interactive structure 400 or other location to determine that the mobile computing device system 300 is located proximate these known devices.

The mobile computing device system 300 further includes a power source 315, such as a battery, for powering various circuits and other devices that are used to operate the mobile computing device system 300. Embodiments of the mobile computing device system 300 may also include a clock or other timer 350 configured to determine and, in some cases, communicate actual or relative time to the processor 310 or one or more other devices.

The mobile computing device system 300 also includes a memory 320 operatively coupled to the processor 310. As used herein, memory includes any computer readable medium (as defined herein below) configured to store data, code, or other information. The memory 320 may include volatile memory, such as volatile Random Access Memory (RAM) including a cache area for the temporary storage of data. The memory 320 may also include non-volatile memory, which can be embedded and/or may be removable. The non-volatile memory can additionally or alternatively include an electrically erasable programmable read-only memory (EEPROM), flash memory or the like.

The memory 320 can store any of a number of applications which comprise computer-executable instructions/code executed by the processor 310 to implement the functions of the mobile computing device system 300 and/or one or more of the process/method steps described herein. For example, the memory 320 may include such applications as a conventional web browser application 322 and/or an interactive structure application 321 (or any other application provided by the managing entity system 200). These applications also typically instructions to a graphical user interface (GUI) on the display 330 that allows the user 110 to interact with the mobile computing device system 300, the managing entity system 200, and/or other devices or systems. In one embodiment of the invention, when the user 110 decides to enroll in the interactive structure application 321 program, the user 110 downloads, is assigned, or otherwise obtains the interactive structure application 321 from the managing entity system 200, or from a distinct application server (e.g., from a computing device of the interactive structure 400). The interactive structure application 321 may, in some embodiments, be a component of a general mobile device application provided and maintained by the managing entity system. 200 In other embodiments of the invention, the user 110 interacts with the managing entity system 200, the interactive structure 400, another mobile computing device system 300, or a third party system 120 via the web browser application 322 in addition to, or instead of, the interactive structure application 321.

The interactive structure application 321 may facilitate communication between a user 110 or a specialist 115 and one or more of the computing devices of the interactive structure 400. For example, the interactive structure application 321 of the mobile computing device system 300 of the specialist 115 may be configured to receive user input of instructions from the specialist 115 that is transmitted to an exterior display of the interactive structure 400 to cause the exterior display to perform one or more demonstrative tasks that can be accomplished by a user (e.g., the user 110) engaging with the interactive structure 400. As another example, the interactive structure application 321 may be configured to prompt the user 110 to provide personal information about the user 110, authentication information about the user 110, a purpose for engaging with the interactive structure 400, and the like, where the interactive structure application 321 then transmits the input from the user 110 to the managing entity system 200 and/or one or more devices of the interactive structure 400. Furthermore, the interactive structure application 321 may be configured to receive user input from the user 110 that is transmitted to an interior display of the interactive structure 400, thereby serving as a user input device or component in a video conferencing or telepresence system.

The memory 320 of the mobile computing device system 300 may comprise a Short Message Service (SMS) application 323 configured to send, receive, and store data, information, communications, alerts, and the like via the wireless telephone network 152.

The memory 320 can also store any of a number of pieces of information, and data, used by the mobile computing device system 300 and the applications and devices that make up the mobile computing device system 300 or are in communication with the mobile computing device system 300 to implement the functions of the mobile computing device system 300 and/or the other systems described herein.

FIGS. 4A-4G illustrate multiple views of a sample representation of interactive structure 400 of FIG. 1. As shown in FIGS. 4A-4G, the interactive structure 400 may comprise one or more side panels 402 and/or window panels 403 operatively coupled to a plurality of struts 404 to form walls of the interactive structure 400. The side panels 402 may be made of wood, metal, or an opaque polymer material that is configured to dampen sound to provide a quiet interior of the interactive structure 400 and reduce the likelihood that any audible communication between the user and devices within the interior of the interactive structure 400 (e.g., the interior display 422). Similarly, the window panels 403 may be made out of glass or a transparent or translucent polymer that allows light into the interior of the interactive structure 400 but also provides the same or similar noise dampening features of the side panels 402. The struts 404 may be made of a metal or polymer material that provide structural support for the rest of the interactive structure 400. The struts 404 may additionally be configured to be removably attached to the side panels 402 and/or the window panels 403, such that the struts 402, the side panels 402, and the window panels 403 can be separated (e.g., collapsed), transported separately (e.g., on crates), and deployed in a different location. The side panels 402, window panels 403, and/or struts 404 may be comprised of flame-retardant material.

The interactive structure 400 also includes a door 418 comprised of the same or similar material as the window panels, the door 418 configured to provide access to the interactive structure 400 when an access device 420 of the door is in an unlocked configuration. The access device 420 may be a card reader device, a near field communication (NFC) reader device, or another computing device configured to connect to, or otherwise engage with, a mobile computing device (e.g., a mobile computing device system 300 of the user 110 or the specialist 115). For example, the access device 420 of the door 418 may be configured to transform from a locked configuration to an unlocked configuration in response to detecting the presence of a magnetic strip of a card. In other examples, the access device 420 may be configured transform from a locked configuration to an unlocked configuration in response to receiving a signal from a mobile computing device system 300. This signal may comprise authentication credentials of a customer (e.g., the user 110), instructions from authorized personnel (e.g., the specialist 115) to unlock the door, identification information for a customer (e.g., the user 110), one or more known or requested desired actions that the customer would like to perform while inside the interactive structure 400, one or more known or received purposes for the customer interacting with the interactive structure 400, or the like.

Of course, the access device 420 may also be in wireless network communication (e.g., via a local cellular network, mobile hotspot, a Wi-Fi hotspot, a wireless local area network, or the like) with one or more other computing devices associated with the interactive structure 400. For example, an exterior display 414 may be in wireless network communication with the access device 420, and in response to receiving information about a customer (e.g., the user 110) and/or a request to enter the interactive structure 400 to perform a desired action, the exterior display 414 may transmit computer readable instructions across the wireless network communication to the access device 420 to cause the access device 420 to transform from a locked configuration to an unlocked configuration. The transmission from the exterior display 414 to the access device 420 may further include information about the customer that has been input to (or selected via a touchscreen of) the exterior display 414.

Similarly, the access device 420 may be in wireless network communication with a mobile computing device system 300 of an employee of an entity that manages the interactive structure 400 (e.g., the specialist 115), such that the employee is able to receive information from a potential customer, authorize the customer's access to the interactive structure 400, and cause the mobile computing device system 300 of the employee to transmit instructions across the wireless network to the access device 420 to cause the access device 420 to transform from a locked configuration to an unlocked configuration.

The access device 420 may further be in wireless network communication with a mobile computing device system 300 of a customer (e.g., the user 110), such that the customer can scan an NFC chip embedded within the mobile computing device system 300 of the customer to transmit information associated with the customer and/or the mobile computing device system 300 of the customer to the access device 420. Additionally or alternatively, the customer may be have a mobile device application stored in the mobile computing device system 300 of the customer that enables the user, via the mobile computing device system 300, to input information about the customer, issues that the customer would like to resolve, account information about the customer, a purpose for engaging with the interactive structure 400, or the like into the mobile device application. This mobile device application may be configured to then transmit this information provided by or selected by the customer from the mobile computing device 300 of the customer to the access device 420.

The access device 420 may also be in wireless network communication with the interior display 422 of the interactive structure 400, such that information input or otherwise transmitted to the access device 430 (e.g., either directly by, or via computing device systems of, the specialist 115 or the user 110) is transmitted on to the interior display 422 for the purpose of initiating a communication with a customer entering the interactive structure 400 to ultimately perform a desired action of the customer.

Other devices of the interactive structure 400 may be in wireless network communication with the access device 420. For example, a physical presence detector (e.g., a customer camera 424, a motion detection device (not pictured), a weight sensor (not pictured), or the like) may be configured to turn on or transform from an idle to an active state in response to the access device 420 being transformed from a locked configuration to an unlocked configuration. A security camera 428 may similarly be activated and/or may receive information about the customer entering the interactive structure 400 (e.g., authentication credentials provided, identification information provided, purpose for engaging with the interactive structure 400, and the like), such that the security camera can store this associated information along with the recorded visual and/or audio input. In this way, the security camera 428 is able to store a log of information linked in time to the visual and audio recordings that will be useful to individuals reviewing security tape to determine information about individuals that have entered the interactive structure 400. Of course, the access device 420 may also be in network communication with other computing devices and/or systems illustrated in FIG. 1 including, but not limited to, the managing entity system 200 and a third party system 120, such that information about a customer (e.g., identification information for the customer, authentication information for the customer, purpose for the customer engaging with the interactive structure 400, account information for the customer, and the like) can be communicated between the access device 420 and these other devices and/or systems.

The interactive structure 400 may further include an exterior bench 412 that houses electronic components for one or more of the devices of the interactive structure 400 and is topped by a seat that can be used by a potential customer and/or an employee of the entity managing the interactive structure 400. Because the exterior bench 412 includes electronic components within its housing, the exterior bench 412 may include one or more air vents, fans, electronic component cooling systems, or the like to prevent the electronic components from overheating. The inclusion of electronic components within the exterior bench for the devices associated with the interactive structure 400 enables the interior of the interactive structure 400 to remain quieter, creating an environment that is more conducive to verbal and audio communication between a customer and the interior display 422 than environments where noisy electronic components are included in the interior of a relatively compact structure.

The exterior bench 412 may be affixed to, operatively coupled to, or otherwise attached to a side panel 403, a wall base panel 407, or a strut 404 of the interactive structure 400 such that the exterior bench 412 cannot be easily separated from the interactive structure 400 when in an installed configuration. Of course, the exterior bench 412 may still be able to be separated from, for example, a side panel 402 by a break-down and transportation technician for the purpose of collapsing the interactive structure 400, storing individual units of the interactive structure 400 in crates, pallets, or other transport structures for transportation, and re-deploying the interactive structure 400 in a different location. For example, the exterior bench 412 may be secured to a side panel 402 via multiple screws, such that it would be difficult for an individual to quickly remove each of the multiple screws and remove the exterior bench 412 from the interactive structure 400.

Because most, or all, of the electronic components supporting the devices of the interactive structure 400 are housed within the exterior bench 412, the exterior bench 412 can serve as a central hub that provides a direct avenue for repairs, regular service, or diagnostics to be performed. For example, a bench-top to the exterior bench 412 may be hinged to lift up (or may be entirely removable) such that a technician can access these electronic components to perform the repair, service, and/or diagnostic tasks. An identifier (e.g., unique identification code) for the interactive structure 400 can be housed within or on the exterior bench 412 as well.

The electrical components of the exterior bench 412 may include a secure cellular service hot-spot, a secure Wi-Fi hotspot, or another secure wireless near field communication device or system that is configured to provide wireless network connectivity to the one or more devices of the interactive structure 400 and to one or more mobile computing device systems 300 such that these mobile computing device systems 300 can interact securely with the devices of the interactive structure 400. In this way, the computing devices and other electronic devices of the interactive structure 400 can be in network communication without the need for additional wires that would complicate the ability for this interactive structure 400 to be taken apart, collapsed into transportable units, and deployed or otherwise reassembled. Furthermore, in embodiments where the wireless communication network comprises a secure cellular service hotspot, the devices associated with the interactive structure 400 will be interacting at speeds comparable to being hard-wired, improving customer experience and system functionality through the highly connected and expeditious response times of the devices.

The electrical components of the exterior bench 412 may also include power converters, battery back-up systems, surge protectors, circuit breakers, or the like for one or more of the devices associated with the interactive structure 400. In some embodiments, the interactive structure 400 is connected to a power grid, via the components of the exterior bench 412. In other embodiments, the exterior bench may include a generator, a large battery pack configured to supply enough energy to power the computing devices and other electronic components of the interactive structure 400, or the like. The interactive structure 400 may, in some embodiments, comprise a plug-and-play system that is configured to tap into a single electrical outlet (e.g., via an electrical plug) to supply the electricity to power the components (e.g., exterior displays 414, access device 420, interior display 422, customer camera 424, and the like).

As shown in FIGS. 4A-4G, the interactive structure 400 may include exterior displays 414 affixed to, operatively coupled to, or otherwise attached to side panels 402 of the interactive structure 400. While the exterior displays 414 are illustrated with a particular size and horizontal orientation, it should be known that the size and orientation of the exterior displays 414 may be different. In some embodiments, these exterior displays 414 comprise all or most of the same components described with respect to the mobile computing device system 300 of FIG. 3. For example, the exterior displays 414 may include a user interface (similar or identical to the user interface 330) comprising one or more visual displays and audio speakers, while also including one or more input devices like a microphone, a keyboard, a touchscreen, or the like. In this way, the exterior display is able to provide information and notifications to nearby individuals via visual displays and/or audio speakers, and to receive information from individuals (e.g., potential customers) via the user input devices.

In some embodiments, the exterior displays may provide a QR code, or any other image, code, Internet address, or the like that can be captured by or entered into a mobile computing device system 300 of a potential customer, whereby capturing or entering the code, image, or the like, causes the mobile computing device system 300 to establish a communication link to the exterior display(s) 414 (e.g., via a secure cellular network hot-spot). In this way, a potential customer can provide one or more user inputs that can be received, read, acted upon, and the like, by an exterior display 414.

The exterior displays 414 may present information about the interactive structure 400, the entity that manages the interactive structure 400, products or services of the entity managing the interactive structure 400 that can be obtained through engaging with the interactive structure 400, one or more actions that can be performed by a customer through engaging with the interactive structure 400, and the like. As such, a potential customer may be able to transmit (to the exterior displays 414, to the access device 420, to the interior display 422, or to the managing entity system 200) a selection of the type of action the customer would like to perform, a purpose for engaging with the interactive structure 400, a request for a type of action that the customer would like to perform, information about the customer, or the like, based on the displayed information on the exterior displays. Of course, the exterior display 414 will be configured to never display personal information about an individual interacting with the exterior display 414, even if the individual provides information (e.g. identity information, account information, authentication credentials, or the like) through the interaction with the exterior display 414.

As described with respect to FIG. 1, one or more specialists 115 (e.g., employees of a managing entity, product ambassadors, action demonstration specialists, or the like) may be stationed by or with the interactive structure 400. A specialist 115 may have a mobile computing device system 300 that is in network connectivity to one or more of the devices of the interactive structure 400 (e.g., the exterior displays 414, the access device 420, the interior display 422, or the like). As such, the specialist 115 is able to cause these devices of the interactive structure 400 to perform certain functions through input of the specialist 115 into the computing device system 300.

For example, the specialist 115 is able to demonstrate or simulate service capabilities, including how a potential customer can interact with the interior display 422, by the specialist 115 interacting with an exterior display 414 by using the mobile computing device system 300. In some such embodiments, at least a portion of the exterior display 414 mirrors the display of the mobile computing device system 300 of the specialist 115, enabling the specialist 115 to show a potential customer how to operate a mobile computing device system 300 of the potential customer to engage with the interior display 422. In other such embodiments, the exterior display 414 provides a sample visual and/or audio presentation that responds to inputs provided by the mobile computing device system 300 of the specialist 115, enabling the specialist 115 to show a potential customer what the interior display 422 will generally look like and how the interior display will present information, questions, confirmations, notifications, alerts, and the like when the potential customer engages with the interior display 422 of the interactive structure 400.

The exterior and/or interior of the window panels 403 of the interactive structure 400 may be at least partially covered with screen obfuscation material 430 that comprises a film that is configured to be translucent or transparent such that most light passes through unobstructed by the screen obfuscation material 430, but that is configured to also obfuscate, distort, darken, black-out, or otherwise block light waves emitted from a light emitting diode (LED) screen from passing through. In this way, anyone viewing an LED display from a vantage point that is not through the screen obfuscation material 430 is able to successfully view the images, text, or other information presented on the LED display. However, anyone viewing an LED display from a vantage point that passes through the screen obfuscation material 430 will not see any light from the LED display, thereby completely blocking the images, text, or other visual information from the LED display.

By including the screen obfuscation material 430 on at least a portion of the window panels 403 of the interactive structure 400, customers inside the interactive structure 400 are able to clearly see the visual information presented on the interior display 422 (i.e., in embodiments where the interior display 422 comprises or includes an LED display), but individuals that are outside of the interactive structure 400 looking into the interactive structure 400 are unable to view the visual information presented on the interior display 422 because of the screen obfuscation material 430 that blocks the light emitted by the interior display 422. In this way, the customer (e.g., a user 110) is able to view personal information, account information, transaction information, financial information, and other sensitive information on the interior display 422 without other individuals seeing that same information. From an external perspective, viewing the interior display 422 through the screen obfuscation material 430, an individual would see a black screen. This solution of using the screen obfuscation material 430 permits the interactive structure 400 to include glass or other transparent or translucent material in its window panels 403, thereby letting in external light and reducing or eliminating the need for artificial lighting to be included within the interactive structure 400 itself, while still providing a high level of data privacy and security for the customer and the information presented on the interior display 422.

While the screen obfuscation material 430 is illustrated as covering a portion of the window panels 403, it should be known that the screen obfuscation material can be applied across the entirety of the window panels 403, different portions of the window panels 403, or the like, along only the window panels 403 where the interior display 422 is visible, or the like, as long as screen obfuscation material 430 blocks vantage points to the interior display 422 of most individuals. For example, the screen obfuscation material 430 may be applied to (or be embedded within) the entirety of the window panels 403, such that there are no vantage points from outside of the interactive structure 400 that would allow an individual to view the information displayed on the interior display 422. In some embodiments, the screen obfuscation material 430 is applied to at least the window panels 403 from which the interior display 422 is visible to cover an area from a height of three feet and a half feet from the ground to six and a half feet from the ground.

In other embodiments, an opaque, or slightly translucent film may be applied to the window panels 403 in the same manner and locations as the above-described screen obfuscation material 430 to allow some exterior light to enter the interior of the interactive structure 400, while blocking any views of the interior display 422 from the outside of the interactive structure 400. In other embodiments, at least a portion of the window panels 403 include suspended particles that are randomly dispersed throughout the window panel 403, causing a slightly translucent or opaque window, and that align in a single direction when a voltage is applied to create a transparent window. In such embodiments, the access device 420 may include a switch or other mechanism that maintains a voltage through such a window panel 403 to cause the window panel 403 to be transparent when the interior of the interactive structure 400 is empty, but cuts the voltage to cause the window panel 403 to become translucent or opaque in response to unlocking the door 418 or determining that a customer is inside the interactive structure 400.

In some embodiments, the interactive structure 400 may further include one or more banners 416 that display a brand name of the managing entity, information about the interactive structure 400, information about the products or services that can be acquired through engaging with the interactive structure 400, information about the actions that can be performed through engaging with the interactive structure 400, or the like. These banners 416 may be adhered to, painted onto, etched into, or otherwise made a component of the side panels 402, the window panels 403, the struts 404, the external bench 412, the door 418, or the like.

Wall base panels 407 may line the bottom sides of the interactive structure 400, and may be operatively coupled to the side panels 402, window panels 403, and struts 404 to provide additional structural support and definition. Furthermore, the wall base panels 407, may be operatively coupled to the floor 406 of the interactive structure 400. The floor 406 may be comprised of one or multiple floor panels that are configured to operatively couple, fit together, link together, slide together, or the like, to provide a level and solid surface on which a customer can stand, and on which other structures like the interior bench 424, a writing surface 426 (e.g., a table), and the like may be positioned and/or secured.

The interactive structure 400 may additionally include ceiling baffling 410 that provides noise dampening functionality to block or minimize the dispersal of sensitive information from inside the interactive structure 400 from reaching the surrounding environment and to provide a quieter internal environment within the interactive structure 400 to better facilitate communication between a customer and the interior display 422. The use of the ceiling baffling 410 additionally permits external light to enter the interactive structure 400 from above, reducing or eliminating the need for installing artificial lights within the interactive structure 400 itself. The ceiling baffling 410 may further include or comprise lighting features (e.g., light bulbs, LED lights, fluorescent lighting, halogen bulbs, xenon bulbs, or the like) within or operatively coupled to the ceiling baffling 410.

In addition to the ceiling baffling 410, the interactive structure 400 may further include one or more ceiling panels 408, as shown in FIG. 4E. These ceiling panels 408 may be comprised of transparent or translucent material, such that exterior light is able to pass through the ceiling panels, thereby reducing or eliminating the need to include artificial light within the interactive structure 400 itself. The ceiling panels 408 may comprise clear and/or substantially white material to maintain or provide a bright effect within the interactive structure 400. The ceiling panels 408 may further include or comprise lighting features (e.g., light bulbs, LED lights, fluorescent lighting, halogen bulbs, xenon bulbs, or the like) within or operatively coupled to the ceiling panels 408.

Because the interactive structure 400 can be installed indoors (e.g., within a shopping center, within an office complex, within a merchant building, within an education building, or the like), the interactive structure 400 must adhere to important fire safety standards, such as a requirement for structures within larger buildings to either be open to the external elements or to be able to receive water or other fluid emitted from fire sprinklers of the larger building. Therefore, in some embodiments, the ceiling panels 408 are not installed on the top of the interactive structure 400, and only the ceiling baffling 410 is included atop the interactive structure 400. In other embodiments, the ceiling panels 408 comprise a polymer material that is configured to melt-away in response to being exposed to fluids, including water. In this way, the ceiling panels 408 can provide additional privacy and security by dampening noise emitted from the interactive structure 400 while providing a quiet environment within the interactive structure 400, while also meeting fire and safety requirements to allow sprinkler water or other fluid to enter the interactive structure 400 by melting away when exposed to the sprinkler water or other fluid.

In another embodiment, the individual ceiling panels 408, or all of the ceiling panels 408 as a whole unit, may include one or more sensors configured to detect water, and a hydraulic lever or other lever mechanism. In such embodiments, the lever mechanism may be configured to lift, rotate, open, or otherwise move the ceiling panels 408 or the whole unit, in response to receiving a signal from the one or more sensors configured to detect the water, thereby opening the top of the interactive structure 400 to permit water or other fluid to enter the interior of the interactive structure 400.

The interactive structure 400, as illustrated in FIGS. 4A-4G may include a physical presence sensor that may be embodied in the form of the customer camera 424, a weight sensor (not shown) embedded within at least a portion of the floor, a facial pattern sensor embodied in the form of the customer camera 424, or a motion sensor (e.g., a component of the customer camera 424 or the security camera 428) or attached to a side panel 402, a strut 404, or a ceiling baffle 410. The physical presence sensor may be configured to monitor the interior of the interactive structure 400 to detect when an individual (e.g., a customer) is present within the interactive structure 400. For example, in embodiments where the physical presence sensor comprises a weight sensor in the floor 406 of the interactive structure 400, the weight sensor may receive an increase in weight in the floor that is indicative of the presence of an individual (e.g., an increase in measured weight above a predetermined threshold).

In some embodiments, the physical presence sensor is turned on, activated, or transformed from an idle state to an active state in response to receiving a prompt or alert from the access device 420 (e.g., in response to the access device transforming from a locked configuration to an unlocked configuration).

Once the physical presence sensor detects the presence of a customer (e.g., the user 110), the physical presence sensor may transmit an alert, prompt, notification, or other computer readable instructions to the interior display 422, causing the interior display 422 to turn on, activate, or otherwise transform from an idle state to an active state. For example, in response to a customer inserting a card with a magnetic stripe into a card slot of the access device 420, the access device may transmit an alert to the customer camera 424 to cause the customer camera to actively monitor the interactive structure 400 for movement or a change in the images that are obtained by the customer camera 424. When the customer camera 424 does detect a movement or change in the images that are obtained, the customer camera 424 transmits computer readable instructions to the interior display 422, causing the interior display to transform from an idle state into an active state that is capable of communicating with the customer via touch screen input, other keypad or keyboard input, or via a secure connection with a mobile computing device system 300 of the customer.

In some embodiments, the customer camera 424 and the interior display 422 are connected, linked, or comprise the same computing device, such that together they function as a single telepresence unit that is capable of, and configured to, allow the customer to virtually interact with a representative located remotely. Additionally, or alternatively, customer camera 424 may provide information to the managing entity system 200 controlling the interior display 422 that may enable the managing entity system 200 to provide a tailored interaction experience with the customer. For example, the customer camera 422 may be configured to take one or more images of the customer and securely transmit those images (e.g., via a secure and dedicated communication channel) to the managing entity system 200. The managing entity system 200 may then compare the received image(s) of the customer in the interactive structure 400 to a database of known images and/or known features of clients or known customers of the managing entity in an attempt to determine a match that indicates the identity of the customer.

In some embodiments, the access device 420 or another computing device of the interactive structure 400 (or the mobile computing device system 300 of the specialist) may transmit information about the identity, or purported identity, of the customer prior or along with the image(s) of the customer taken by the customer camera 424. In such embodiments, the managing entity system 200 may identify known images or image features of the customer based on the received customer information or purported customer information, and compare these known images or image features of the customer to the received image(s) of the customer provided by the customer camera 424 to determine whether the provided customer identity likely matches the identity of the individual currently located in the interactive structure 400.

If the purported customer identity does not match the identity determined by the managing entity system 200 based on the image of the individual in the interactive structure 400, then the managing entity system 200 may cause the interior display to present a request for the individual within the interactive structure 400 to provide additional authentication credentials (e.g., a password, financial information, a passcode, an answer to a security question, or the like), and/or may deny an interaction with the individual within the interactive structure 400.

In embodiments where the managing entity system 200 does confirm the identity of the customer within the interactive structure 400, or where the identity of the customer is determined by the managing entity system 200 by the image(s) received from the customer camera 424, the managing entity system 200 may cause the interior display 422 to present information about the customer (e.g., identity information, financial information, transaction history, available products or services that the customer does not yet have, or the like), thereby personalizing the engagement with the customer within the interactive structure 400. For example, if a customer enters the interactive structure 400, the customer camera 424 may record an image of the customer and transmit that image to the managing entity system 200. The managing entity system then identifies an identity of that customer based matching the image of the customer to a database of images for known customers. In response to determining the identity of the customer, the managing entity system 200 may identify all available personal and financial information and transmit that information, or make that information readily available, to the interior display 422 or a system controlling the interior display 422.

The interior display 422 comprises at least an LED display, and may include a microphone, speakers, a touchscreen, or other user input and/or output devices. The interior display 422 may be comprised of the same or similar components that are described with respect to the mobile computing device system 300. As such, the interior display 422 is configured to present information via a visual display and/or via speakers, and is configured to receive user input from the customer via the touchscreen, a keyboard or keypad, a microphone, or the like. In some embodiments, the interior display 422 prompts the user to connect with the interior display 422 via a computing device system 300 of the customer. For example, the interior display 422 may present a QR code, an Internet website address, or a request for the customer to tap the mobile computing device system 300 against an NFC reader device, whereby any such interaction causes the computing device system 300 to connect to a local cellular network hotspot or other wireless network with the interior display. In such embodiments, the mobile computing device system 300 of the customer may comprise the user input device that provides information to the interior display 422 and/or the managing entity system 200 as a whole. In some embodiments, the interactive structure 400 includes a mobile computing device system 300 within the interactive structure 400 (e.g., tethered to the interior bench 426 or the writing surface 427), where this mobile computing device system 300 is already in secure wireless network communication with the interior display 422 such that a customer can immediately provide user input via this computing device system 300 in response to prompts, instructions, or requests from the interior display.

The security camera 428 may be attached to a side panel 402, a window panel 403, a strut 404, a ceiling baffle 410, or the like such that it is positioned to monitor or otherwise record the interior of the interactive structure 400. In some embodiments, the security camera 428 additionally serves as the physical presence sensor for the interactive structure 400 by detecting movement or a change in the recorded image within the interactive structure 400 that likely is indicative of an individual being present within the interactive structure 400.

The interior of the interactive structure 400 may further include an interior bench 426 that is easily accessible and positioned in front of the interior display 422 and customer camera 424 such that a customer sitting on the interior bench 426 is able to easily see information presented on the interior display 422 while also being in view of the customer camera 424, thereby providing an easy and comfortable environment for a telepresence interaction that uses the interactive structure 400.

In some embodiments, the interactive structure 400 further includes a writing surface 427 that is attached to the floor 406 and/or the interior bench 426, thereby providing a stable surface on which the customer is able to write, place valuables, place documents, or the like. In some embodiments, the writing surface 427 comprises a touch-screen display of a computing device system (e.g., similar to the exterior display(s) 414, the interior display 422, and/or the mobile computing device system 300), such that the user may provide user input via the touch screen display of the writing surface. As such, the writing surface 427 may be in wireless network communication with the interior display 422 and/or the managing entity system 200 to receive prompts that are to be presented to the customer via the writing surface 427 and/or to transmit user input provided by the customer to the interior display 422 and/or the managing entity system 200. The interior bench 426 and/or the writing surface 427 may include one or more electrical outlets, USB ports, mobile computing device charging stations, and the like that allow customers to charge their mobile computing device systems 300, link their mobile computing device systems 300 to the connected network of the interactive structure 400, and the like.

The interactive structure 400 may be of a height to permit individuals to stand inside the interactive structure 400 without needing to bend down, feel like they are in a small space, or the like. For example, the distance from the floor 406 to the bottom of the ceiling baffles 410 may be approximately eight feet, or more.

Because of the modular nature of the interactive structure 400, each component, or sets of components, of the interactive structure 400 can be separated from other components of the interactive structure 400. In this way, the interactive structure 400 can be broken down into smaller units that are crated, placed on pallets, or otherwise prepared for shipping. For example, the exterior displays 414, the customer camera 424, the interior display, and the security camera 428 may be separated from their respective side panels 402, window panels 403, and/or struts 404 and packaged into a first crate. Additionally, the exterior bench 412, the interior bench 426, and the writing surface 427 can be separated from their respective side panels 402, window panels 403, struts 404, wall base panels 407, and the floor 406 and packaged together in a second crate. Finally, the side panels 402, the window panels 403, the struts 404, the door 418 and access device 420, the ceiling baffling 410, and the ceiling panels 408 can be separated from each other and packaged in a third crate. These three crates can then be transported to any location, where the contents can be taken out and re-assembled to deploy the interactive structure 400 in the new location. It should be known that not all of the components may be fully separated in order to transfer them to other locations. For example, the side panels 402 and window panels 403 for each particular side of the interactive structure 400 may remain intact throughout the break-down and transportation phase, thereby reducing the amount of work needed to be completed to disassemble and reassemble the interactive structure 400.

Referring now to FIG. 5, a flowchart is provided to illustrate one embodiment of a process 500 for use of a collapsible and deployable interactive structure, in accordance with embodiments of the invention. In some embodiments, the process 500 may include block 502, where the system provides an interactive structure that is collapsible and deployable, where the interactive structure includes at least a door with a locking mechanism, an interior display, and a physical presence sensor.

The interactive structure may, in some embodiments, be the same as, or include at least some of the features of, the interactive structure 400 described with respect to FIGS. 4A-4G. As such, the interactive structure may further comprise at least one of the following components described in more detail with respect to FIGS. 4A-4G: side panels 402, window panels 403, screen obfuscation material 430 (e.g., screen obfuscation film) attached to at least a portion of the window panels 403, support struts 404, an exterior bench 412 housing electronic components associated with one or more devices of the interactive structure 400, ceiling baffling 410, ceiling panels 408 or tiles comprising material configured to melt away in response to being exposed to water, a local cellular network hot-spot (e.g., housed within the exterior bench 412) configured to connect one or more device associated with the interactive structure, a customer camera 424, a security camera 428, a door access device 420, one or more exterior displays 414, one or more interior benches 426, a writing surface 427 that includes electrical outlets and/or other ports to allow mobile computing devices to connect to or charge through the interactive structure, or any other feature or combination of features described with respect to the interactive structure 400 of in FIGS. 1 and 4A-4G.

The computing devices of the interactive structure may be in secure, wireless network communication with each other, as described with respect to FIGS. 4A-4G, such that the devices are able to transmit messages, instructions, notifications, alerts, activation signals, data, information, or other communications to the other devices. Additionally or alternatively, the devices of the interactive structure may be configured to transmit information, notifications, alerts, instructions, and other communications to a managing entity system (e.g., the managing entity system 200 described with respect to FIG. 1 and FIG. 2), and to receive messages, alerts, instructions, activation signals, and other communications from the managing entity system.

In some embodiments, one or more mobile computing devices (e.g., the mobile computing device systems 300 described with respect to FIG. 1 and FIG. 3) may be in secure, wireless network communication with the electronic or computing devices of the interactive structure. This secure wireless connection may be through a cellular network hot-spot stored in an external bench of the interactive structure, via a cellular service, via an Internet service, via near field communication (e.g., NFC, RFID, and the like), or any other wireless connection. Of course embodiments such as the dedicated cellular network hot-spot, and Internet connections via a secure online porta, provide additional levels of data and information security that are beneficial for safely and securely interacting with a customer, potential customer, or employee of the managing entity.

In this way, one or more of the remaining steps to this process 500 described herein may be performed automatically by one or more of the devices of the interactive structure (including the one or more mobile computing devices in network communication with the interactive structure), and/or through instructions provided to the device(s) by a managing entity system that is controlling the operation of the interactive structure.

The door and locking mechanism of the interactive structure may include an electronic access device secured to the door and/or a strut or side panel of the interactive structure, where the access device is configured to control the locking mechanism of the door. As such, the access device may be configured to change the configuration of the locking mechanism from a locked state to an unlocked state, or vice-versa, in response to certain inputs, as described more precisely herein.

The physical presence sensor of the interactive structure may be one or more sensors, devices with sensors, or the like, that are configured to detect a presence of an individual or multiple individuals within the interactive structure. In one embodiment, the physical presence sensor may comprise a weight sensor that is embedded within, or is positioned underneath, a floor of the interactive structure. One or more weight sensors may be positioned in front of the interior display, just within the door, under (or within) the interior bench, or the like, such that a more precise location of the individual within the interactive structure can be determined.

For example, a first weight sensor may be just within the door, such that the sensor detects when an individual is entering the interactive structure. This detection of the user may cause the weight sensor to transmit an alert to another device (e.g., to the interior display) to cause that device to perform a function (e.g., to cause the interior display to turn on, activate, and/or display a welcome message, video, recorded message, or the like). A second weight sensor may be positioned in front of the interior display (e.g., within the floor and/or within or underneath the interior bench) to determine when an individual is in a position that is optimal for engaging with an employee of the managing entity through a video conference. In some embodiments, the floor of the interactive structure may include indications of where the user should stand, sit, or otherwise be positioned to be within the optimal position(s) for video conferencing. In response to the second weight sensor detecting a change in measured weight, or in detecting a weight above a predetermined threshold, the second sensor may transmit an alert to cause the interior display to automatically connect with an employee of the managing entity system via a videoconferencing or telepresence application, such that the user is automatically put into communication with the employee when the user is in the optimal position for a video conference.

A second, non-exclusive, embodiment of the physical presence sensor is a motion sensor that is configured to detect a physical change in the interior environment of the interactive structure that is indicative of an individual being present within the interactive structure. As with the weight sensor(s), the motion sensor(s) may be positioned within the interactive structure to detect a presence of individuals as they enter through the door, as they are positioned in an optimal location with respect to the interior display, or the like, and these motion sensors may be in network connection with one or more other devices within the interactive structure to transmit alerts based on the detection of a physical presence.

A third, non-exclusive embodiment of the physical presence sensor is a visual motion sensor that is configured to record and analyze images or video to detect a change in the recorded images or video that are indicative of the presence of an individual within the interactive structure. In some embodiments, the visual motion sensor may comprise a customer camera and/or a security camera that are located within the interactive structure. As with the other physical presence sensors, one or more visual motion sensors may be positioned to detect when an individual has entered the interactive structure (e.g., by the security camera), and/or when the individual is in an optimal location for interacting with the interior display as a telepresence unit (e.g., by the customer camera).

A fourth non-exclusive embodiment of the physical presence sensor is a facial pattern detection sensor that is configured to scan real-time images or video for features that are indicative of a face, thereby determining that a customer, user, or other individual is present within the interactive structure.

The interior display of the interactive structure may comprise any embodiment of the interior display 422 described with respect to FIGS. 4A-4G, and therefore may include a visual display (e.g., an LCD screen), one or more speakers, one or more cameras (e.g., the customer camera 424 of FIGS. 4A-4G), and user input components (e.g., a keypad, a keyboard, a touchscreen, remote control, physical gesture sensor, or the like). The interior display may be configured as a telepresence unit that is positioned within the interactive structure such that a customer inside the interactive structure can easily engage with a connected employee of the managing entity via the user input and device output components of the interior display. The interior display may be configured to receive inputs, instructions, data, information, alerts, messages, and the like from any of the other computing devices described herein.

The interactive structure is configured to be broken down, placed in or on transportation crates or pallets, and easily transported to any location, including within larger building structures. For example, the interactive structure may be positioned within a shopping center, a business center, an automobile dealership, a real estate office, a merchant building, a university building, an airport terminal, a convention center, a sport complex (e.g., arena, stadium, or the like), a train car, a hospital, or the like. Additionally, the interactive structure is configured to be positioned in an outdoor environment as well. For example, this interactive structure can quickly be mobilized and deployed in a location of an outdoor festival, a sporting event (e.g., in a parking lot or field adjacent to an arena or stadium), in a disaster area where traditional brick and mortar locations are not available or are not configured to handle a recent or expected influx in action requests, emerging market regions, or the like.

The use of window panels along with ceiling baffling and/or translucent or transparent ceiling tiles enable the interactive structure to provide an interior environment that has substantially the same lighting as the exterior environment, whether that exterior environment is an outdoor area illuminated by the sun or an enclosed larger building with artificial lighting. Additionally, the inclusion of ceiling panels that are made of a material that melts away when exposed to water allows for the interactive structure to meet fire and safety codes when positioned within a larger enclosed structure. For example, the ceiling panels will melt away without harming an occupant in the event the sprinkler system of the larger building turn on, thereby allowing the water from the sprinkler system to enter the interactive structure.

In some embodiments, the process 500 includes block 504, where the system initiates a communication with a user. As used herein with respect to FIG. 5, the "user" may be a customer, potential customer, client, or any other individual or group of individuals that can engage with the interactive structure to perform one or more desired actions. The user may be the same as, or similar to the user 115 of FIG. 1. A second individual or group of individuals may be present as well: a specialist (e.g., the specialist 115 of FIG. 1), or other ambassador, employee, agent, or other representative of the managing entity that owns, manages, or otherwise oversees the interactive structure and/or the actions that are performed through the engagement between the user and the interactive structure.

In some embodiments, the user has a mobile computing device (e.g., a smart phone, tablet, smart watch, or the like), and communicating with the user may comprise communicating with the user via the mobile computing device of the user. Similarly, the specialist may have a mobile computing device, and interacting with the user may comprise interacting with the user via the mobile computing device of the specialist, and/or communicating with the user via the specialist who then inputs information about the user, the desired actions the user would like to perform, or the like into the mobile computing device of the specialist.

Furthermore, the exterior displays of the interactive system may be utilized to initiate communication with the user and/or to carry out further communication steps with the user. For example, the exterior displays may present one or more offers that are available for qualified individuals that engage with the interactive system. The exterior displays may additionally or alternatively describe the functionality of the interactive structure and provide instructions for how a user can engage with the interactive structure or its devices.

In embodiments of the interactive structure where the door includes an access device, the initiation of the communication with the customer may be conducted via the access device. For example, a sign, the exterior displays, the specialist, the mobile computing device of the user, or the like may prompt the user to present authentication credentials (e.g., a magnetic stripe of a card, a passcode, an NFC chip, or the like) to the access device to initiate the engagement with the interactive structure.

The initiation of the communication may include providing a computing device with a touch screen (e.g., an exterior display like the exterior display 414) that can prompt potential users to engage with the interactive structure by providing a user input to the touch screen device. In such embodiments, the system may receive a user input, via the touch screen display of the exterior display of the interactive structure, of a request to enter the interactive structure. The system may then prompt, via the external display of the interactive structure, the user to provide authentication credentials of the user.

Providing authentication credentials may comprise scanning, entering, or otherwise offering the authentication credentials to an access device of the interactive structure, to an interactive structure application stored on the mobile device of the customer, to an online portal associated with the interactive structure, or the like. The authentication credentials may comprise a passcode, password, biometric data or information (e.g., a retinal scan, a fingerprint scan, a facial scan, or the like), the presentation of a magnetic stripe of a card, an answer to a posed security question, or the like.

Once the system has received the authentication credentials of the user and, in response, compare the authentication credentials to a database of known authentication credentials to determine that the provided authentication credentials match respective stored known authentication credentials.

As part of the initial communication with the user, the system may be configured to determine an identity of the user based on information provided by the user. The determination of the identity of the user may comprise simply prompting the user to provide a name or identification number of the user, and receiving the user input (e.g., via a touchscreen of the exterior display, via a mobile computing device of the user or a specialist, via the access device, via a touchscreen of the interior display, or the like). In some embodiments, determining the identity of the user does not require any additional actions by the user like entering the user's personal information. Instead, the system may determine the identity of the user through a facial recognition application. As such, the system may use a security camera, a customer camera, and/or a camera of a mobile computing device of the specialist or the user to capture at least one image of the face of the user. The system can then compare the image(s) of the face of the user to a database of known customers and associated facial features or characteristics to determine a best match.

This facial recognition process can also be done to verify a purported identity of the user. For example, when the user has input personal identification information, the system can capture an image of the user and compare that image to known facial features that match the input personal identification information to determine whether the facial features of the user matches. If there is a match, the user is validated or authenticated. If there is not a match, the system can request that the user provide additional authentication or validation credentials before proceeding to display any personal or financial information about the user on the interior display.

As will be described in more detail below, the determined identity of the user may be useful in determining the information that should be presented on the interior display, in predicting the desired action(s) of the user, and for security purposes.

Initiating the communication with the user may, in some embodiments, comprise receiving user information, including authentication credentials of the user, from a mobile computing device of a specialist that has communicated with the user. The user may be instructed or prompted by the exterior displays of the interactive structure and/or the specialist to input certain information into the mobile computing device of the specialist to request access to the interactive structure, to provide identification or personal information that will allow the managing entity system to tailor the engagement experience with the interactive structure, to unlock the locking mechanism of the door to the interactive structure, or the like.

Additionally, in some embodiments, the process 500 includes block 506, where the system authenticates the user based on the communication with the user. As such, the step of authenticating the user based on the communication with the user may comprise confirming that the received authentication credentials of the user matches information associated with the user that is stored in an authentication database accessible to the system of the managing entity.

In response to authenticating the user, the process 500 may proceed to block 508, where the system unlocks the locking mechanism on the door. In some embodiments, an access device is configured to transform the locking mechanism from a locked configuration (i.e., the door is closed and locked) to an unlocked configuration (i.e., the door is closed or open and is not locked in a closed position). Because the interactive structure may be positioned within a larger building like a shopping center, the door, lock, and access device may meet fire and safety requirements such that the door is never completely locked when an individual is turning a door handle from the inside of the interactive structure.

In some embodiments, the process 500 includes block 510, where the system receives an indication from the physical presence sensor that the user is inside the interactive structure. As described above, one or more physical presence sensors (e.g., weight sensors, motion sensors, visual sensors, or the like) may be positioned within the interactive structure to detect the presence of an individual (i.e., the user), or a location within the interactive structure that the individual is located (e.g., just inside the door, in front of the interior display, on the interior couch, or the like).

Additionally, in some embodiments, the process 500 includes block 512, where the system causes the interior display to communicate with the user to determine a desired action associated with the user. As described above, the interior display may automatically turn on, activate, change from an idle state to an active state, or open or initiate a teleconference or telepresence application configured to facilitate communication between the user and an employee of the managing entity (e.g., via videoconference), a chatbot configured and managed by the managing entity system, or the like.

In embodiments where an employee of the managing entity conducts a video conference with the user via the interior display (including the customer camera and other user inputs and device outputs), the employee can provide a list of available actions that the user can select from, a list of action types that the user can select from, or the like. Additionally or alternatively, the employee can ask the user to provide additional information about what the user would like to accomplish with the engagement with the interactive structure, and provide guidance for steps that can be taken to meet any goals.

Similarly, a chatbot, artificial intelligence-based communication application, or the like may be associated with the interior display such that the user is able to communicate with these systems or applications in a similar manner to embodiments where the user is communicating with an employee. These systems or applications may be managed or otherwise operated via a managing entity system (which may be the system performing one or more of the steps in this process 500), where the managing entity system accesses a knowledge base, a database of customer information (including account information, transaction history, user history, or the like) to provide prompts, questions, and responses to user input based on certain logic rules and parameters.

As described above, the interior display may include user input devices or components such as the user camera (e.g., detects or records gestures), a microphone that is configured to record or otherwise receive audible input, a keypad or keyboard, a touchscreen input system, or the like. Additionally or alternatively, the user may provide user input via a mobile computing device (e.g., via an interactive structure application stored on the mobile computing device) of the user, a mobile computing device (e.g., a tablet) that is stored within the interactive structure and automatically in wireless network connection with the interior display, or the like.

The user experience within the interactive structure will be substantially similar to brick and mortar centers, albeit via virtual interaction. For example, in embodiments where the managing entity system comprises a financial institution, the user will be able to perform almost all traditional financial interactions, such as receiving all financial institution services, managing accounts, making payments, applying for financial products, and the like.

The enclosed nature of the interactive structure, including the noise dampening features of the wall panels, window panels, ceiling baffling, and/or ceiling tiles, provides a relatively quiet environment within the interactive structure that allows a user to clearly hear audible messages from the interior display, and for the microphone of the interior display to clearly pick up any audible communication from the user. The noise dampening features additionally provide a layer of protection for the user when the user or the interior display is verbally disclosing sensitive (e.g., personal or financial) information.

The use of screen obfuscation material (or an opaque or translucent material) on at least the areas of window panels where individuals outside of the interactive structure are able to view the interior display provide an added level of information and data security for the customer without significantly reducing the amount of light that is able to enter and illuminate the interior of the interactive structure, thereby reducing or eliminating the need for interior artificial lighting.

In some embodiments, the system may predict the action that will be performed by the user. For example, the system may determine a predicted desired action of the user. The system may accomplish this task by first determining a purpose of the user for engaging with the interactive structure. The system may prompt the user to disclose a purpose during the initial communication steps (e.g., via the exterior display, via the communication with a specialist (e.g., where the specialist enters a determined purpose into a mobile computing device of the specialist), via the mobile computing device of the user (e.g., after prompting the user to provide a purpose via the mobile computing device), via the access device, or the like.

In some embodiments, the purpose is determined based at least partially on a location of the interactive structure (or a pre-set expected interaction). For example, if the interactive structure is located within an automobile dealership, then information about the automobile dealership, the forms used by the automobile dealership, the types of financial products relating to the automobile dealership that would be available to customers of the automobile dealership, or the like may be programmed into the applications run by the system. As such, the system may predict that any interaction with the interactive structure in this location will be for the purpose of requesting one or more of the types of financial products that relate to the automobile dealership. While the automobile dealership example is provided herein, it should be known that other types of merchants or organizations may be able to utilize the same or similar features of the interactive structure and system of use. For example, the interactive structure could be positioned within a real estate office and configured to help facilitate mortgage documents or applications, or other home loan documents.

Of course, the system may receive a purpose directly from the user. For example, the user may be interacting with an application on the mobile computing device of the user, and through this interaction provide an indication that the user is interested in saving funds for a particular good or service. This purpose can then be transmitted from the mobile computing device of the user to the managing entity system and/or directly to the interior display or another device of the interactive structure (e.g., the access device).

In other embodiments, the system may determine a purpose for the user engaging with the interactive device based on financial information for that user. For example, the system may analyze account information and/or transaction history of the user to determine a likely purpose based on previous interaction patterns, previous account activity, or the like.

The system may then predict a desired action for the user based on the determined purpose of the user for engaging with the interactive structure. For example, in embodiments where the interactive structure is located within an automobile dealership, the system may predict a desired action for the user of acquiring an automobile loan product that meets the requirements of the automobile dealership. In another example, if the determined purpose of the user is to transfer a certain amount of funds to another individual or entity, the system can predict that the desired action will be to transmit the certain amount of funds from a particular account of the user to a particular account of the other individual or entity.

Next, the system may collect available user information and user account information necessary to perform the predicted desired action. Using the automobile loan product example, the system may automatically pull up one or more template forms for applying for an automobile loan product that would meet the requirements of the user and/or the automobile dealership. The system can then identify which information is needed to populate each field of the template form(s). Once the system has identified which information is needed, the system can search account information for the user, personal information on record for the user, information about the automobile dealership that is stored in an accessible database, time and date information, and the like to identify which information is available. This available information is then populated within the respective fields of the template form(s) to either fully complete the required forms or to fill in as much of the required forms as possible without additional user input.

The system may request, via the interior display, a confirmation from the user to perform the predicted desired action. If needed, the system can also request from the user, via the interior display, additional information necessary to perform the predicted desired action. This additional information may comprise the information that was not identified by the system when filling out the template form(s). The system may also request confirmations that the information that the system automatically populated into the forms is accurate and up to date. For example, the system can determine that a physical address of the user was input over five years ago, and has not been updated or confirmed since that date. And in response to this determination, the system can prompt the user to confirm whether the stored address is still accurate, or request a user input of an updated physical address.

The system may then receive user input, via the interior display or a mobile computing device of the user, comprising the additional information necessary to perform the predicted desired action from the user. In this way, the system can generate any required or desired forms, applications, transaction fields, and the like for the user with minimal user input, due to the highly connected and predictive nature of the devices and systems associated with the interactive structure.

Finally, the process 500 may conclude with block 514, where the system performs the desired action associated with the user. In embodiments where the desired action has been predicted by the system and the system has requested additional information from the user, the system may, in response to receiving user input comprising the requested additional information necessary to perform the predicted desired action, perform the predicted desired action and display information associated with the action to the user via the interior display.

Performing the desired action may comprise executing a transaction that was previously generated or set up, establishing a new account with the managing entity, submitting and/or processing a financial product (e.g., a loan application), executing a financial product (e.g., an investment product), changing personal information on record with the managing entity, scheduling follow-up conferences or communications, or the like.

In response to performing the desired action, the system may prompt the user, via the interior display, to confirm whether the user has any other desired actions to prepare and perform. If so, the system can again determine the desired action associated with the user, generate any associated forms, provide any additional information to the user about the desired action, and perform the desired action after receiving confirmation or permission from the user.

In some embodiments, a sticker, sign, or notification may be posted on the interior or exterior of the interactive structure, where the notification includes a QR code, a website address, or the like that can be captured or entered into the computing device of the user. This notification may instruct or otherwise cause the computing device system of the user to present a survey, questionnaire, or feedback request to the user. Similarly, the interior display may present a survey, questionnaire, or feedback request to the user once the desired action(s) has been completed to determine whether the user's experience with the specialist and/or the interactive structure was as expected, or if any additional information or actions would be beneficial to the user.

As will be appreciated by one of skill in the art, the present invention may be embodied as a method (including, for example, a computer-implemented process, a business process, and/or any other process), apparatus (including, for example, a system, machine, device, computer program product, and/or the like), or a combination of the foregoing. Accordingly, embodiments of the present invention may take the form of an entirely hardware embodiment, an entirely software embodiment (including firmware, resident software, micro-code, and the like), or an embodiment combining software and hardware aspects that may generally be referred to herein as a "system." Furthermore, embodiments of the present invention may take the form of a computer program product on a computer-readable medium having computer-executable program code embodied in the medium.

Any suitable transitory or non-transitory computer readable medium may be utilized. The computer readable medium may be, for example but not limited to, an electronic, magnetic, optical, electromagnetic, infrared, or semiconductor system, apparatus, or device. More specific examples of the computer readable medium include, but are not limited to, the following: an electrical connection having one or more wires; a tangible storage medium such as a portable computer diskette, a hard disk, a random access memory (RAM), a read-only memory (ROM), an erasable programmable read-only memory (EPROM or Flash memory), a compact disc read-only memory (CD-ROM), or other optical or magnetic storage device.

In the context of this document, a computer readable medium may be any medium that can contain, store, communicate, or transport the program for use by or in connection with the instruction execution system, apparatus, or device. The computer usable program code may be transmitted using any appropriate medium, including but not limited to the Internet, wireline, optical fiber cable, radio frequency (RF) signals, or other mediums.

Computer-executable program code for carrying out operations of embodiments of the present invention may be written in an object oriented, scripted or unscripted programming language such as Java, Perl, Smalltalk, C++, or the like. However, the computer program code for carrying out operations of embodiments of the present invention may also be written in conventional procedural programming languages, such as the "C" programming language or similar programming languages.

Embodiments of the present invention are described above with reference to flowchart illustrations and/or block diagrams of methods, apparatus (systems), and computer program products. It will be understood that each block of the flowchart illustrations and/or block diagrams, and/or combinations of blocks in the flowchart illustrations and/or block diagrams, can be implemented by computer-executable program code portions. These computer-executable program code portions may be provided to a processor of a general purpose computer, special purpose computer, or other programmable data processing apparatus to produce a particular machine, such that the code portions, which execute via the processor of the computer or other programmable data processing apparatus, create mechanisms for implementing the functions/acts specified in the flowchart and/or block diagram block or blocks.

These computer-executable program code portions may also be stored in a computer-readable memory that can direct a computer or other programmable data processing apparatus to function in a particular manner, such that the code portions stored in the computer readable memory produce an article of manufacture including instruction mechanisms which implement the function/act specified in the flowchart and/or block diagram block(s).

The computer-executable program code may also be loaded onto a computer or other programmable data processing apparatus to cause a series of operational steps to be performed on the computer or other programmable apparatus to produce a computer-implemented process such that the code portions which execute on the computer or other programmable apparatus provide steps for implementing the functions/acts specified in the flowchart and/or block diagram block(s). Alternatively, computer program implemented steps or acts may be combined with operator or human implemented steps or acts in order to carry out an embodiment of the invention.

As the phrase is used herein, a processor may be "configured to" perform a certain function in a variety of ways, including, for example, by having one or more general-purpose circuits perform the function by executing particular computer-executable program code embodied in computer-readable medium, and/or by having one or more application-specific circuits perform the function.

Embodiments of the present invention are described above with reference to flowcharts and/or block diagrams. It will be understood that steps of the processes described herein may be performed in orders different than those illustrated in the flowcharts. In other words, the processes represented by the blocks of a flowchart may, in some embodiments, be in performed in an order other that the order illustrated, may be combined or divided, or may be performed simultaneously. It will also be understood that the blocks of the block diagrams illustrated, in some embodiments, merely conceptual delineations between systems and one or more of the systems illustrated by a block in the block diagrams may be combined or share hardware and/or software with another one or more of the systems illustrated by a block in the block diagrams. Likewise, a device, system, apparatus, and/or the like may be made up of one or more devices, systems, apparatuses, and/or the like. For example, where a processor is illustrated or described herein, the processor may be made up of a plurality of microprocessors or other processing devices which may or may not be coupled to one another. Likewise, where a memory is illustrated or described herein, the memory may be made up of a plurality of memory devices which may or may not be coupled to one another.

While certain exemplary embodiments have been described and shown in the accompanying drawings, it is to be understood that such embodiments are merely illustrative of, and not restrictive on, the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein.

The invention claimed is:

1. A system for use of a collapsible and deployable interactive structure, the system comprising:

an interactive structure that is collapsible and deployable, wherein the interactive structure comprises at least a door with a locking mechanism, an interior display, and a physical presence sensor;

a memory device; and a processing device operatively coupled to the memory device, wherein the processing device is configured to execute computer-readable program code to:

initiate communication with a user;

authenticate the user based on the communication with the user;

unlock the locking mechanism of the door in response to authenticating the user;

receive an indication from the physical presence sensor that the user is inside the interactive structure, wherein the indication from the physical presence sensor further comprises an instruction to the interior display to enter into an active state;

cause the interior display to communicate with the user to determine a desired action associated with the user, wherein the desired action performed by the interior display comprises a predicted desired action, and wherein determining the desired action comprises:

determining a purpose of the user for engaging with the interactive structure; and predicting a desired action for the user based on the purpose of the user for engaging with the interactive structure; and perform the predicted desired action associated with the user and display information associated with the predicted desired action to the user.

2. The system of claim 1, wherein initiating the communication with the user comprises:

receiving a user input, via a touch screen of an external display of the interactive structure, of a request to enter the interactive structure;

prompting, via the external display of the interactive structure, the user to provide authentication credentials of the user;

receiving the authentication credentials of the user; and in response to receiving the authentication credentials of the user, unlocking the locking mechanism of the door.

3. The system of claim 1, wherein initiating the communication with the user comprises receiving user information, including authentication credentials of the user, from a mobile computing device of a specialist that has communicated with the user.

4. The system of claim 1, wherein:

initiating communication with the user comprises receiving authentication credentials of the user via an access device associated with the door of the interactive structure; and authenticating the user based on the communication with the user comprises confirming that the received authentication credentials of the user matches information associated with the user stored in an authentication database.

5. The system of claim 1, wherein the processing device is further configured to execute computer-readable program code to determine an identity of the user based on identification information provided by the user.

6. The system of claim 1, wherein processing device is further configured to execute computer-readable program code to:

collect available user information and user account information necessary to perform the predicted desired action;

request, via the interior display, confirmation from the user to perform the predicted desired action;

request, via the interior display, additional information necessary to perform the predicted desired action from the user;

receive user input, via the interior display or a mobile computing device of the user, comprising the additional information necessary to perform the predicted desired action from the user; and in response to receiving the user input comprising the additional information necessary to perform the predicted desired action, perform the predicted desired action and display information associated with the action to the user.

7. The system of claim 1, wherein the interactive structure further comprises at least one of the following components: side panels, window panels, screen obfuscation film attached to at least a portion of the window panels, support struts, an external bench housing electronic components associated with one or more devices of the interactive structure, ceiling baffling, ceiling tiles comprising material configured to melt away in response to being exposed to water, a local cellular network hot-spot configured to connect one or more devices associated with the interactive structure, a customer camera, a security camera, a door access device, and one or more external displays.

8. A computer program product for the use of a collapsible and deployable interactive structure, the computer program product comprising at least one non-transitory computer readable medium comprising computer readable instructions, the instructions comprising instructions for:

initiating communication with a user, wherein the communication with the user is associated with an introduction to an interactive structure that is collapsible and deployable, wherein the interactive structure comprises at least a door with a locking mechanism, an interior display, and a physical presence sensor;

authenticating the user based on the communication with the user;

unlocking the locking mechanism of the door in response to authenticating the user;

receiving an indication from the physical presence sensor that the user is inside the interactive structure;

causing the interior display to communicate with the user to determine a desired action associated with the user, wherein the desired action performed by the interior display comprises a predicted desired action, and wherein determining the desired action comprises:

determining a purpose of the user for engaging with the interactive structure; and predicting a desired action for the user based on the purpose of the user for engaging with the interactive structure, wherein the indication from the physical presence sensor further comprises an instruction to the interior display to enter into an active state; and performing the predicted desired action associated with the user and display information associated with the predicted desired action to the user.

9. The computer program product of claim 8, wherein initiating the communication with the user comprises:

receiving a user input, via a touch screen of an external display of the interactive structure, of a request to enter the interactive structure;

prompting, via the external display of the interactive structure, the user to provide authentication credentials of the user;

receiving the authentication credentials of the user; and in response to receiving the authentication credentials of the user, unlocking the locking mechanism of the door.

10. The computer program product of claim 8, wherein initiating the communication with the user comprises receiving user information, including authentication credentials of the user, from a mobile computing device of a specialist that has communicated with the user.

11. The computer program product of claim 8, wherein:

initiating communication with the user comprises receiving authentication credentials of the user via an access device associated with the door of the interactive structure; and authenticating the user based on the communication with the user comprises confirming that the received authentication credentials of the user matches information associated with the user stored in an authentication database.

12. The computer program product of claim 8, wherein the computer readable instructions further comprise instructions for determining an identity of the user based on identification information provided by the user.

13. The computer program product of claim 8, wherein the computer readable instructions further comprise instructions for:

collecting available user information and user account information necessary to perform the predicted desired action;

requesting, via the interior display, confirmation from the user to perform the predicted desired action;

requesting, via the interior display, additional information necessary to perform the predicted desired action from the user;

receiving user input, via the interior display or a mobile computing device of the user, comprising the additional information necessary to perform the predicted desired action from the user; and in response to receiving the user input comprising the additional information necessary to perform the predicted desired action, performing the predicted desired action and display information associated with the action to the user.

14. The computer program product of claim 8, wherein the interactive structure further comprises at least one of the following components: side panels, window panels, screen obfuscation film attached to at least a portion of the window panels, support struts, an external bench housing electronic components associated with one or more devices of the interactive structure, ceiling baffling, ceiling tiles comprising material configured to melt away in response to being exposed to water, a local cellular network hot-spot configured to connect one or more devices associated with the interactive structure, a customer camera, a security camera, a door access device, and one or more external displays.

15. A computer implemented method for the use of a collapsible and deployable interactive structure, said computer implemented method comprising:

providing a computing system comprising a computer processing device and a non-transitory computer readable medium, where the computer readable medium comprises configured computer program instruction code, such that when said instruction code is operated by said computer processing device, said computer processing device performs the following operations:

initiating communication with a user, wherein the communication with the user is associated with an introduction to an interactive structure that is collapsible and deployable, wherein the interactive structure comprises at least a door with a locking mechanism, an interior display, and a physical presence sensor;

authenticating the user based on the communication with the user;

unlocking the locking mechanism of the door in response to authenticating the user;

receiving an indication from the physical presence sensor that the user is inside the interactive structure;

causing the interior display to communicate with the user to determine a desired action associated with the user, wherein the desired action performed by the interior display comprises a predicted desired action, and wherein determining the desired action comprises:

determining a purpose of the user for engaging with the interactive structure; and predicting a desired action for the user based on the purpose of the user for engaging with the interactive structure, wherein the indication from the physical presence sensor further comprises an instruction to the interior display to enter into an active state; and performing the predicted desired action associated with the user and display information associated with the predicted desired action to the user.

16. The computer implemented method of claim 15, wherein initiating the communication with the user comprises:

receiving a user input, via a touch screen of an external display of the interactive structure, of a request to enter the interactive structure;

prompting, via the external display of the interactive structure, the user to provide authentication credentials of the user;

receiving the authentication credentials of the user; and in response to receiving the authentication credentials of the user, unlocking the locking mechanism of the door.

17. The computer implemented method of claim 15, wherein initiating the communication with the user comprises receiving user information, including authentication credentials of the user, from a mobile computing device of a specialist that has communicated with the user.

18. The computer implemented method of claim 15, wherein:

initiating communication with the user comprises receiving authentication credentials of the user via an access device associated with the door of the interactive structure; and authenticating the user based on the communication with the user comprises confirming that the received authentication credentials of the user matches information associated with the user stored in an authentication database.

19. The computer implemented method of claim 15, wherein the computer implemented method further comprises:

collecting available user information and user account information necessary to perform the predicted desired action;

requesting, via the interior display, confirmation from the user to perform the predicted desired action;

requesting, via the interior display, additional information necessary to perform the predicted desired action from the user;

receiving user input, via the interior display or a mobile computing device of the user, comprising the additional information necessary to perform the predicted desired action from the user; and in response to receiving the user input comprising the additional information necessary to perform the predicted desired action, performing the predicted desired action and display information associated with the action to the user.

20. The computer implemented method of claim 15, wherein the interactive structure further comprises at least one of the following components: side panels, window panels, screen obfuscation film attached to at least a portion of the window panels, support struts, an external bench housing electronic components associated with one or more devices of the interactive structure, ceiling baffling, ceiling tiles comprising material configured to melt away in response to being exposed to water, a local cellular network hot-spot configured to connect one or more devices associated with the interactive structure, a customer camera, a security camera, a door access device, and one or more external displays.

* * * * *